US009643204B2

(12) United States Patent
Ray

(10) Patent No.: US 9,643,204 B2
(45) **Date of Patent: *May 9, 2017**

(54) FLAMELESS CANDLE WITH INTEGRATED FOUNTAIN

(71) Applicant: Brian Ray, Saint Charles, IL (US)

(72) Inventor: Brian Ray, Saint Charles, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/738,064

(22) Filed: Jun. 12, 2015

(65) Prior Publication Data

US 2015/0276204 A1 Oct. 1, 2015

Related U.S. Application Data

(63) Continuation-in-part of application No. 13/769,949, filed on Feb. 19, 2013, now Pat. No. 9,080,762.
(Continued)

(51) Int. Cl.

| | |
|---|---|
| ***F21V 33/00*** | (2006.01) |
| ***F21S 8/00*** | (2006.01) |
| ***B05B 17/08*** | (2006.01) |
| ***F21S 6/00*** | (2006.01) |
| ***F21S 9/02*** | (2006.01) |
| ***F21V 31/00*** | (2006.01) |
| ***F21S 10/00*** | (2006.01) |
| *F21W 121/02* | (2006.01) |
| *F21W 121/00* | (2006.01) |

(Continued)

(52) U.S. Cl.

CPC ..... *B05B 17/08* (2013.01); *F21S 6/001* (2013.01); *F21S 9/02* (2013.01); *F21S 10/002* (2013.01); *F21V 31/005* (2013.01); *F21V 23/00* (2013.01); *F21V 23/045* (2013.01); *F21W 2121/00* (2013.01); *F21W 2121/02* (2013.01); *F21Y 2101/00* (2013.01)

(58) Field of Classification Search

CPC ..... B05B 17/08; B05B 17/085; F21V 33/00; F21W 2121/00; F21W 2121/02; F21Y 2101/02

USPC ..... 362/96, 569; 239/12, 17, 18, 20

See application file for complete search history.

(56) References Cited

U.S. PATENT DOCUMENTS 3,702,172 A * 11/1972 Hawkins ..... F21S 8/00 239/18

4,858,826 A 8/1989 Robinson et al.

(Continued)

FOREIGN PATENT DOCUMENTS

| | | |
|---|---|---|
| CN | 2483103 | 3/2002 |
| CN | 101956866 | 1/2011 |

*Primary Examiner* — Andrew Coughlin
*Assistant Examiner* — Alexander Garlen
(74) *Attorney, Agent, or Firm* — Kinne IP Group; Charles C Kinne; Mary E Adams

(57) ABSTRACT

A decorative display apparatus comprising a flameless candle with an integrated fountain is disclosed. The flameless candle with integrated fountain is designed to be a stand-alone device. The flameless candle with integrated fountain includes a translucent candle body containing a water reservoir to which an optional scent may be added, an optional sealed transparent cover, a power source which may be a battery, USB or DC supply from an AC converter, a pump and an integrated water and light diffuser. The flameless candle with integrated fountain may be operated in either candle-only mode or candle and fountain mode. The device may also be operated on a timer.

25 Claims, 14 Drawing Sheets

Related U.S. Application Data

(60) Provisional application No. 61/602,297, filed on Feb. 23, 2012.

(51) Int. Cl.

| | |
|---|---|
| *F21V 23/00* | (2015.01) |
| *F21V 23/04* | (2006.01) |
| *F21Y 101/00* | (2016.01) |

(56) References Cited

U.S. PATENT DOCUMENTS

| | | | | |
|---|---|---|---|---|
| 4,892,250 | A | 1/1990 | Fuller et al. | |
| 4,975,811 | A | 12/1990 | Fraser et al. | |
| 5,165,777 | A | 11/1992 | Kira | |
| 5,165,778 | A | 11/1992 | Matthias et al. | |
| 5,207,499 | A | 5/1993 | Vajda et al. | |
| 5,775,586 | A | 7/1998 | Hamilton-Bruzzi et al. | |
| 6,241,362 | B1 | 6/2001 | Morrison | |
| 6,279,835 | B1 | 8/2001 | Hansen | |
| 6,416,197 | B1 | 7/2002 | Chang | |
| 6,439,471 | B2 | 8/2002 | Ehrlich | |
| 6,443,364 | B1 * | 9/2002 | Lin | B05B 17/08 239/17 |
| 6,607,144 | B1 | 8/2003 | Yen | |
| 6,641,056 | B2 | 11/2003 | Kuykendal et al. | |
| 6,877,883 | B2 | 4/2005 | Lau Ting Yup et al. | |
| 6,921,023 | B1 | 7/2005 | Bright et al. | |
| 6,971,779 | B2 | 12/2005 | Tau et al. | |
| 7,384,165 | B2 | 6/2008 | Doyle | |
| 7,784,959 | B2 | 8/2010 | Yang | |
| 8,123,381 | B1 | 2/2012 | Wray | |
| 8,167,446 | B2 | 5/2012 | Wesselmeier | |
| 2001/0036609 | A1 * | 11/2001 | Ehrlich | F21V 35/00 431/253 |
| 2003/0147235 | A1 * | 8/2003 | Lin | F21S 10/002 362/101 |
| 2004/0104282 | A1 | 6/2004 | Wooten et al. | |
| 2004/0179351 | A1 | 9/2004 | Patterson | |
| 2005/0129546 | A1 * | 6/2005 | Lin | B05B 17/08 417/527 |
| 2007/0053174 | A1 * | 3/2007 | Lin | B05B 17/08 362/96 |
| 2007/0190471 | A1 * | 8/2007 | Lin | F21S 13/12 431/320 |
| 2008/0101054 | A1 * | 5/2008 | Scali | E04H 4/14 362/96 |
| 2009/0250528 | A1 * | 10/2009 | Schnuckle | B05B 17/08 239/18 |
| 2011/0062250 | A1 | 3/2011 | Betz et al. | |

* cited by examiner

FLAMELESS CANDLE WITH INTEGRATED FOUNTAIN

CROSS-REFERENCE TO RELATED APPLICATIONS

This application is a continuation-in-part of U.S. patent application Ser. No. 13/769,949 filed on Feb. 19, 2013, which claims priority from U.S. Provisional Patent Application Ser. No. 61/602,297, filed Feb. 23, 2012. This application also relates to and claims priority from U.S. Provisional Patent Application Ser. No. 61/602,297, filed Feb. 23, 2012.

FIELD OF THE INVENTION

A decorative display apparatus comprising a flameless candle with integrated fountain is disclosed.

In a preferred embodiment, the candle body comprises an outer sheath that acts as a water reservoir and also contains a non-flammable light source to provide the candle effect. The flameless candle device has an underwater pump located in the water reservoir to create a water fountain effect. The flameless candle with integrated fountain utilizes an integrated water and light diffuser which can provide a simultaneous flame and fountain effect, or a flame effect only. To improve safety and portability, the top of the water reservoir may optionally be sealed with a clear cover.

In another embodiment, a power source is located in a lower compartment which is sealed to the interior of the outer sheath with a lower annular gasket. This lower annular gasket serves to provide a water tight seal between the outer sheath and the lower compartment as well as providing dimensional flexibility between the lower compartment and the candle body. The dimensional flexibility prevents the outer sheath from cracking if it shrinks more than the lower compartment in the event that the display apparatus is exposed to low temperatures.

In a further preferred embodiment, the water reservoir is provided with a water tight lining which is sealed to the interior of the outer sheath with an upper annular gasket. This upper gasket provides a water tight seal and also provides dimensional flexibility so that the outer sheath does not crack if the apparatus is exposed to cold temperatures that cause the outer candle body to shrink more than the upper liner.

In a more preferred embodiment, the light source of the flameless candle is an LED.

In a yet more preferred embodiment, batteries are the power source for the flameless candle with integral fountain.

In a still more preferred embodiment, the flameless candle with integral fountain is provided with an optional remote control to turn it on or off.

In a further preferred embodiment, the flameless candle with integral fountain is provided with an optional means to emit pleasing scents.

BACKGROUND OF THE INVENTION

There is need for a safe, self-contained unit combining the decorative effect of a candle combined with the soothing sound of a water fountain that does not need an external source of power. The following patents and published applications illustrate the efforts of others to address the problems identified and solved by the disclosure herein. As can be seen, there are a vast array of efforts already existing to provide decorative apparatus for the creation of pleasing sensory effects, but none provides the combination of features and advantages presented in the instant disclosure.

These references include: U.S. Pat. No. 8,167,446 entitled "Spotlight and Water Fountain," issued to Wesselmeier on May 1, 2012; U.S. Pat. No. 8,123,381 entitled "LED Lighting Systems and Methods Useable for Replacement of Underwater Niche Lights and other Applications," issued to Wray on Feb. 28, 2012; U.S. Pat. No. 7,784,959 entitled "Whirlpool Type Aqua-Lamp-Based Candle-Like Lighting Device," issued to Yang on Aug. 31, 2010; U.S. Pat. No. 7,384,165 entitled "Water Feature with an LED System," issued to Doyle on Jun. 10, 2008; U.S. Pat. No. 6,971,779 entitled "Fiber Optic and LED Fountain and Method," issued to Tau et al. on Dec. 6, 2005; U.S. Pat. No. 6,921,023 entitled "Self-Contained Water Display," issued to Bright, et al. on Jul. 26, 2005; U.S. Pat. No. 6,877,883 entitled "Ornamental Sphere," issued to Lau Ting Yup et al. on Apr. 12, 2005; U.S. Pat. No. 6,641,056 entitled "Miniature Fountain," issued to Kuykendal et al. on Nov. 4, 2003; U.S. Pat. No. 6,607,144 entitled "Aquavision Fountains Pot," issued to Yen on Aug. 19, 2003; U.S. Pat. No. 6,443,364 entitled "Candle Stand in Combination with a Fountain," issued to Lin on Sep. 3, 2002; U.S. Pat. No. 6,439,471 entitled "Candle Fountain," issued to Ehrlich et al. on Aug. 27, 2002; U.S. Pat. No. 6,416,197 entitled "Fountain Water Lamp," issued to Chang on Jul. 9, 2002; U.S. Pat. No. 6,279,835 entitled "Fountain Having Background Surface for Displaying Liquid Running Thereover," issued to Hansen on Aug. 28, 2001; U.S. Pat. No. 6,241,362 entitled "Lighted Display Emitting Variable Colors," issued to Morrison on Jun. 5, 2001; U.S. Pat. No. 5,775,586 entitled "Fountain Having Internally Lighted Plume," issued to Hamilton-Bruzzi et al. on Jul. 7, 1998; U.S. Pat. No. 5,207,499 entitled "Integral Light and Liquid Circulation Fitting" issued to Vajda et al. on May 4, 1993; U.S. Pat. No. 5,165,778 entitled "Aquarium Lighting System" issued to Matthias et al. on Nov. 24, 1992; U.S. Pat. No. 5,165,777 (Tab 18) entitled "Lighting Fixture Incorporating Fountain," issued to Kira on Nov. 24, 1992; U.S. Pat. No. 4,975,811 entitled "Method and Apparatus for Illumination of a Liquid Droplet Fountain to Produce Rainbows," issued to Fraser et al. on Dec. 4, 1990; U.S. Pat. No. 4,892,250 entitled "Dynamic Fountain Displays and Methods for Creating the Same," issued to Fuller et al. on Jan. 9, 1990; U.S. Pat. No. 4,858,826 entitled "Colored Flame Water Fountain Illumination System," issued to Robinson et al. on Aug. 22, 1989; U.S. Patent Application Publication No. 2011/0062250 entitled "Flame Effect Generator," published on behalf of Betz et al. on Mar. 17, 2011; U.S. Patent Application Publication No. 2007/0053174 entitled "Fountain," published on behalf of Lin on Mar. 8, 2007; U.S. Patent Application Publication No. 2004/0179351 entitled "Liquid Dispensing System Having a Light Source Attached to a Liquid Dispensing Device," published on behalf of Patterson on Sep. 16, 2004; U.S. Patent Application Publication No. 2004/0104282 entitled "Fountain Having Lighted Portion," published on behalf of Wooten et al. on Jun. 3, 2004; U.S. Patent Application Publication No. 2001/0036609 entitled "Candle Fountain," published on behalf of Ehrlich et al. on Nov. 1, 2001; Chinese Patent No. CN 101956866 (EPO Abstract unavailable) entitled "Water Tap with Light-Emitting Device", published on behalf of Zhou on Jan. 26, 2011; and Chinese Patent No. CN 2483103 (with EPO Abstract) entitled "Candlelight Fountain," published on behalf of Dong et al. on Mar. 27, 2002.

These references are discussed in greater detail as follows.

U.S. Pat. No. 8,167,446 generally discloses a spotlight for use in bodies of water. The spotlight has at least one lighting unit for illuminating fountains, water jets or the like, wherein the lighting unit is liquid-cooled and has at least one light emitting diode or a light emitting diode cluster arranged in the housing.

U.S. Pat. No. 8,123,381 generally discloses light emitting diode lighting systems and methods useable to replace incandescent bulbs or other types of LED light sources in enclosed environments, such as in underwater lighting niches used in swimming pool, spa, fountain and other underwater lighting applications. The LED lighting system generally comprises (A) at least one LED, (B) a circuit board connected to the LED(s) for driving the LED(s) and (C) a corrective apparatus, such as a corrective lens (e.g., a diffuser or holographic diffuser), constructed to prevent, counteract or correct the undesired optical effect of the existing niche lens.

U.S. Pat. No. 7,784,959 generally discloses a whirlpool type aqua-lamp-based candle-shaped lighting device. The device has a stand having a hollow structure forming an open end, a motor fixed inside the stand and having a spindle to which a magnetic piece is mounted and a light generation assembly mounted along a circumference of the open end of the stand. A light-transmittable aqua-lamp base having a three-dimensional and light-transmittable structure forms an internal chamber surrounded by a flowable liquid. The aqua-lamp base further has a passage defined through the aqua-lamp base in communication with the chamber and set at a location corresponding to the open end of the stand. The aqua-lamp base is mounted to the open end of the stand and located above the light generation assembly. A magnetically-driven moving piece being arranged in the aqua-lamp base at a bottom thereof corresponding to the magnetic piece and an illuminator, mounted at an open end of the internal chamber of the aqua-lamp base, is electrically connected with the motor. The motor is set in operation to make the magnetically driven moving piece rotate, the liquid inside the aqua-lamp base is caused to flow in a whirlpool fashion, the light generation assembly projects dazzling lighting and the illuminator generates twinkling lighting.

U.S. Pat. No. 7,384,165 generally discloses a water feature having a housing with an electronics section and a water channel. A printed circuit board with at least one light emitting diode (LED) is provided, where at least a portion of the at least one LED is in direct contact with the water while the electrical section remains waterproof. In embodiments, at least one LED is at least partially in direct contact with the water, for instance as it flows through a jet, nozzle, bubbler, water sheet, rests in a pool or is similarly held in a water feature.

U.S. Pat. No. 6,971,779 generally discloses a lighted table top water fountain which includes a water bowl, a superstructure rising from the water bowl with a view area overhead, a pump supplied with electrical power, and a water delivery system to carry water from the water bowl through the superstructure above the view area and drop the water into the view area. A plurality of light emitting diodes (LEDs) is mounted beneath the view area such that the waterfall is illuminated by the upwardly directed LEDs. A fiber optic light system is mounted between a scene board and a backboard, both of which are mounted at the rear of the superstructure behind the view area. Light generated from the fiber optics is emitted from the scene board into the view area and is reflected and refracted off of the waterfall. Optionally, an audio control turns the lights on and off.

U.S. Pat. No. 6,921,023 generally discloses a self-contained water display. The water display includes cylindrical fountain housing. The fountain housing contains at least one fountain nozzle extending vertically upwardly and at least one pump adapted to supply water to the nozzle with sufficient throughput to cause a vertical water stream to be ejected. A vertically disposed transparent cylindrical cover surrounds the fountain housing with the fountain housing being located in a lower portion of the transparent cylindrical cover. The transparent cylindrical cover has a height above the nozzle that is at least as great as the height of the vertical water stream generated by the fountain nozzle. The fountain housing and the lower portion of the transparent cylindrical cover are surrounded by a lightweight shell simulating a rock. The water display may include a transparent aquarium surrounding the fountain housing and transparent cylindrical cover.

U.S. Pat. No. 6,877,883 generally discloses an ornamental sphere which includes a base and a transparent or translucent sphere mounted on the base. The sphere is completely filled with rheoscopic fluid. A driving apparatus within the sphere is energized to agitate the rheoscopic fluid to thereby create currents or movements that are visible to an observer through the sphere. In addition, a light source is mounted within the sphere to illuminate the rheoscopic fluid and enhance the appearance and visibility of the current movement. The light and/or the driving apparatus can be activated by a plurality of systems. Alternatively, the sphere can be filled with two immiscible fluids having different refractive indexes.

U.S. Pat. No. 6,641,056 generally discloses a self-contained miniature laminar ornamental fountain which comprises an enclosure and water reservoir, a pump, flow control means and pipe or tubing means to conduct water from the pump to a laminar nozzle. The laminar stream emanating from the laminar nozzle forms a graceful arch and then falls back into the reservoir to repeat the cycle. In another embodiment of the invention, the fountain includes one or more additional laminar or non-laminar nozzles. In another embodiment the fountain above the laminar nozzle(s) contains internal lighting means for producing lighted laminar streams. In yet another embodiment in the fountain, the laminar stream(s) are interrupted to form jets of water which appear to leap from place to place.

U.S. Pat. No. 6,607,144 generally discloses an aqua vision fountain pot constructed to include a pot body and a nozzle holder fastened to the pot body at the top. The nozzle holder defines a bottom water chamber and a light chamber and is sealed with a bottom sealing plate carrying a set of LEDS. A water pump is adapted to pump water from the pot body to the water chamber and further to force water out of jet nozzles of the nozzle holder when the LEDs are turned on to emit light. A meshed dashboard is fastened to the nozzle holder and adapted to guide falling water to the inside of the pot body.

U.S. Pat. No. 6,443,364 generally discloses a candle stand in combination with a fountain to provide ornamental effects. The invention includes a hollow base, a candle stand assembly, and a fountain assembly. A pump is disposed inside the base. The candle stand assembly is mounted on top of the base. The fountain includes a hollow connector and a tube communicating the connector to the pump. A bottom semi-sphere is disposed around the connector and on top of the cover plate. A top semi-sphere is disposed around the connector and above the cover plate. An upper plate and a lower plate are disposed around the connector and between the bottom semi-sphere and the top semi-sphere.

U.S. Pat. No. 6,439,471 generally discloses a candle fountain having a base defining a reservoir adapted to hold a fluid, such as water. A pump having an inlet and an outlet is provided in communication with the base reservoir. A candle member is supported on the base, where the candle member includes a bore formed at least partially therethrough having an inlet and at least one outlet. The bore inlet is in fluid communication with the pump outlet so fluid can be pumped from the base reservoir into the bore and out through the one or more bore outlets of the candle member. The candle member can be lit during operation of the candle fountain.

U.S. Pat. No. 6,416,197 generally discloses a fountain water lamp which combines a hallucinating water lamp and a landscape fountain. The fountain water lamp has a transparent unit, a base, a driving unit, a color disk, a light source unit, a circuit board, a water pump and an air pump. The light source unit generates light to project on the transparent films of the color disk for forming colored light to impart into the transparent unit. The air pump delivers air into the transparent unit to generate air bubbles which bob and scatter in the fluid contained in the transparent unit to produce a hallucinating effect under the projection of the light. The fluid in the transparent unit is driven by the air pump and water pump to overflow into a spill channel and a multi-layer passage and to be drawn by the water pump for returning to the transparent unit again to produce circulation flow, to generate the fountain landscape effect. The fountain water lamp may optionally have a housing chamber for holding batteries and an opening for engaging with a lid. The circuit board may be activated by audio frequency or touch contact, and be capable of broadcasting music or songs.

U.S. Pat. No. 6,279,835 generally discloses a water fountain is disclosed for use in residential and commercial environments. The water fountain includes a support frame and a catch basin within which a recirculating pump system is placed. A background flow display surface is attached to the support frame for receiving water from the recirculating pump system. In one embodiment, the water fountain includes a facade connected to the support frame. The facade includes a plurality of apertures such that when the facade is placed over the background flow display surface, a portion of the background flow display surface is visible through the apertures in the facade, thereby permitting visibility of the flowing water as well. The facades may include apertures of various shapes and sizes and in different arrangements. The invention also provides the use of illumination and variable recirculation pumps in order to achieve dramatic visual effects. The invention may include noise-reducing pebbles in order to buffer the noise created by the falling water into the catch basin. The invention provides an effective self-contained water fountain that can be used indoors or outdoors.

U.S. Pat. No. 6,241,362 generally discloses a lighted display device which includes three light emitting diodes, each of the diodes transmitting a different one of the three subtractive primary colors of red, yellow and blue when electrical power is applied thereto. The three LEDs are capable of collectively emitting any of the colors of the visual spectrum, depending upon the relative electrical power which is applied separately and collectively to them. The LEDs are contained in the center of a base, and are installed upon a circuit board which is in turn installed within the base. A light passage is provided in the center of the upper surface of the base, with various articles being installable thereon for supporting translucent statuary, candles, etc. as desired for lighted display thereof. The lighted device includes circuitry for automatically varying the relative intensity of each of the LEDs over a predetermined period of time, resulting in the LEDs collectively emitting a broad spectrum of gradually changing colors over the time period. The circuitry may be adjusted to provide for the transmission of a single color by any one or two of the LEDs if so desired, as well. The lighted display device provides for the display of various translucent art objects and the like, with the varying colors emitted therethrough providing a wide variety of interest as the color and appearance of the displayed object varies.

U.S. Pat. No. 5,775,586 generally discloses a fountain having an internally lighted plume. The primary components of the fountain are a cover, a shallow container, a pump having a vertical translucent spout and at least one lamp. The pump is installed in the container under the cover. The open end of the spout fits in a hole in the cover and the water flowing out of the spout forms a plume and then runs over the surface of the cover past openings in the cover into the container. The lamp(s) is/are installed inside the cover and illuminate the water in the plume through the translucent spout and also illuminate the water as it flows past the openings in the cover.

U.S. Pat. No. 5,207,499 generally discloses a liquid circulation system in a liquid container, a combination light assembly and liquid circulation fitting through which fluid flows to or from the container, wherein the light assembly and circulation fitting forms a unitary structure for installation in the liquid container. The assembly may also include means for cooling the light assembly, including means for circulating air within the light assembly and venting air to the exterior of the liquid container.

U.S. Pat. No. 5,165,778 generally discloses an aquarium lighting system with fiber optic strands for underwater illumination of an aquarium tank, providing LEDs that provide upward illumination. The light sources each include an elongated insulated wire having a light emitting diode on one end. A water impervious encapsulating layer of material extends over the LED lens and preferably seals and electrically insulates the connection between the elongated wire and the light emitting diode. The wire insulation is both waterproof and watertight.

U.S. Pat. No. 5,165,777 generally discloses an illuminated fountain which includes housing with a water chamber in the housing having a cap with perforations and a transparent bottom panel, a lamp in the housing and a mirror for reflecting light from the lamp through the bottom panel of the water chamber. A source of electrical energy is connected to the housing and a pressure switch in the housing is connected between the electrical energy source and the lamp. The pressure switch has a fluid connection with the inlet to the water chamber such that it delivers current to the lamp only when water is flowing to the chamber.

U.S. Pat. No. 4,975,811 generally discloses a method and apparatus for producing primary rainbows and secondary rainbows in a curtain of liquid droplets in the air, whereby the rainbows are produced by refractive dispersion within the droplets themselves, and whereby the rainbows are visible from directly opposite sides of the curtain of droplets. The curtain of liquid droplets is produced by a water fountain. The device of the invention comprises a source of radially distributed light and a source of liquid droplets. The light source can be an array of lights configured so that the light rays appear to emanate from a common center. The light source may also be a collimated light source such as a searchlight which reflects light off a mirror-like conical surface or a combination of such sources. The light source may also be a single light source in a covered curved reflector.

U.S. Pat. No. 4,892,250 generally discloses dynamic fountain displays and methods of creating the same for providing water displays which may substantially constantly vary in interesting and seemingly endless ways. In one form, the fountains are comprised of a matrix of fountain nozzles positioned below a deck formed with open joint paving so as to be useable as a patio or walkway when the fountain is not used. Each nozzle is connected to a source of water under pressure through a control system for that nozzle responsive to a computer output so that each nozzle may be controlled by the computer as desired. Lighting for the water display is also disclosed. Dispersed in an array intermediate the array of openings is a plurality of light sources. These light sources are positioned to bridge the opening between adjacent side edges of adjacent squares both internal to the pattern of nozzle openings and around the periphery of the nozzle opening pattern. The light sources comprise fiber optic bundles mounted so that the tops thereof are just below the tops of the squares.

U.S. Pat. No. 4,858,826 generally discloses a colored flame system for illuminating water fountains. A burner assembly, comprising a main burner, a pilot burner, an igniter, a flame sensor and multiple colorant nozzles is located adjacent to one or more water nozzles of the fountain. A control unit oversees operation of the system. Upon commands from an operator, the control unit causes the pilot and main burners to light and injects the desired colorants into the main burner flame. The colorants are concentrated solutions of metallic salts. The flame sensor acts as a safety device insuring that gas and colorants are emitted only when the pilot and main burners are lit.

U.S. Patent Application Publication No. 2011/0062250 generally discloses a flame effect generator that operably uses a liquid reservoir to provide liquid for use in generation of flame effects, including: a mist generator wherein a mist may be generated from a liquid, one or more light sources which may be directed onto the exiting mist from the flame effect generator to give the effects of flame.

U.S. Patent Application Publication No. 2007/0053174 generally discloses a fountain having a base, a pump, a lighting device and at least one stand. The base holds liquid and has a top opening. The at least one stand is mounted on the top opening of the base and has a top. The pump is mounted inside the base and is connected to the stand. The lighting device is mounted on the top of the stand. When liquid flows through the lighting device, the light from the lighting device is reflected the liquid and enhances the optical appearance by making the flowing liquid look like a candle flame. The lighting device can make the fountain easy and safe to use.

U.S. Patent Application Publication No. 2004/0179351 generally discloses a liquid dispensing system which comprises a liquid dispensing device and a light source that is attached to or located within a close proximity of the liquid dispensing device. Light emitted from the light source illuminates an area in close proximity to the liquid dispensing device. Such light can improve the aesthetic appearance of the liquid dispensing system, particularly when the liquid dispensing system is located in an otherwise dimly lit area.

U.S. Patent Application Publication No. 2004/0104282 generally discloses a fountain having a substantially-rectangular fountain body with a dividing floor disposed horizontally therein. The floor divides the fountain body into a lower chamber open on its bottom end and an upper chamber open on its top end. A conduit, passing through the dividing floor, connects the lower chamber to the upper chamber. A light source is disposed in the lower chamber. A pump, disposed within the upper chamber, pumps water up to a water spout disposed above it, which is returned to the pump by the force of gravity.

U.S. Patent Application Publication No. 2001/0036609 generally discloses a candle fountain having a base defining a reservoir adapted to hold a fluid, such as water. A pump having an inlet and an outlet is provided in communication with the base reservoir. A candle member is supported on the base, where the candle member includes a bore formed at least partially therethrough having an inlet and at least one outlet. The bore inlet is in fluid communication with the pump outlet such that fluid can be pumped from the base reservoir into the bore and out through the one or more bore outlets of the candle member. The candle member can be lit during operation of the candle fountain to provide additional sensory enjoyment.

Chinese Patent No. CN 101956866 (EPO Abstract unavailable) generally discloses a water tap with a light-emitting device, the water tap comprising a main body. The inside of the main body of the water tap is provided with an electric generator and a luminous source and a bubbler arranged at the water outlet nozzle. As space is left between the luminous source and the transparent water outlet cover, light can be fully emitted; and when light passes through the water between the luminous source and the transparent water outlet cover, light is refracted and better light effect can be obtained.

Chinese Patent No. CN 2483103 (with EPO Abstract) generally discloses a candle fountain comprising a base, a candle cylinder and a fountain nozzle. The ring-shape chassis of the nozzle is provided with an insulated lighting lamp holder, on which a dynamic flash luminous element and a flame-shaped lampshade and the lamp holder passes the chassis of the nozzle via the cylinder by an insulated conductor to connect to the power supply. A pipe is also arranged below the center of the chassis of the nozzle, and the pipe penetrates the central via of the cylinder in an insulated way to connect to the program control pump. The fountain not only has solid modeling, but also has dynamic light symbolizing a combustion candle, as well as a candle fountain of high vividness of melting candle vertical flow. The water sprayed is held in the lampshade.

Thus, a problem associated with devices that precede the present disclosure is that they do not provide, in combination with the other features and advantages disclosed herein, a flameless candle with integral fountain that is portable.

A further problem associated with devices that precede the present disclosure is that they do not provide, in combination with the other features and advantages disclosed herein, a flameless candle with integral fountain that is optionally sealed on its top, such that the water of the fountain cannot spill when the flameless candle is moved, and so that children and pets do not have access to the water, integral fountain or light source, thus providing enhanced portability and safety.

Another problem associated with devices that precede the present disclosure is that they do not provide, in combination with the other features and advantages disclosed herein, a flameless candle with integral fountain that is sealed on its top and has glycerin or other suitable antifreeze agent added to the water to prevent freezing in the event of exposure to cold temperatures.

Still another problem associated with devices that precede the present disclosure is that they do not provide, in combination with the other features and advantages disclosed herein, a flameless candle with integral fountain that is suitable for display in an area not near an external source of power, e.g. outdoors.

Yet another problem associated with devices that precede the present disclosure is that they do not provide, in combination with the other features and advantages disclosed herein, a flameless candle with integral fountain that closely resembles in appearance a traditional wax candle.

Still a further problem associated with devices that precede the present disclosure is that they do not provide, in combination with the other features and advantages disclosed herein, a flameless candle with integral fountain that combines the decorative appearance of a candle with a fountain.

An additional problem associated with devices that precede the present disclosure is that they do not provide, in combination with the other features and advantages disclosed herein, a flameless candle with integral fountain that may be operated either as a flameless candle or as a flameless candle with a water feature.

Another problem associated with devices that precede the present disclosure is that they do not provide, in combination with the other features and advantages disclosed herein, a flameless candle with integral fountain that is remote controlled.

An even further problem associated with devices that precede the present disclosure is that they do not provide, in combination with the other features and advantages disclosed herein, a flameless candle with integral fountain that has the option of either being battery powered or powered from an external source, e.g. a USB port or an AC current source transformed to a DC current supply.

Still another problem associated with devices that precede the present disclosure is that they do not provide, in combination with the other features and advantages disclosed herein, a flameless candle with integral fountain that is safe to operate.

A yet further problem associated with devices that precede the present disclosure is that they do not provide, in combination with the other features and advantages disclosed herein, a flameless candle with integral fountain that may optionally be operated on a timer so as to turn off automatically.

A yet still further problem associated with devices that precede the present disclosure is that they do not provide, in combination with the other features and advantages disclosed herein, a flameless candle with integral fountain that is provided with a clear lower compartment containing the power source and switch mechanism such that both the upper and lower portions of the flameless candle emit light.

A further problem associated with devices that precede the present disclosure is that they do not provide, in combination with the other features and advantages disclosed herein, a flameless candle with integral fountain that is provided with a clear inner liner for the water reservoir in the upper portion of an outer wax sheath to provide still further water tightness thus enhancing safety and portability.

Another problem associated with devices that precede the present disclosure is that they do not provide, in combination with the other features and advantages disclosed herein, a flameless candle with integral fountain provided with annular gaskets to provide water tight and dimensionally flexible seals for the space between the clear inner liner, lower compartment and outer wax sheath, thus providing enhanced safety by preventing water spillage and also providing enhanced durability by preventing cracking due dimensional changes between the wax casing and inner lining and lower compartment due to temperature changes.

Another further problem associated with devices that precede the present disclosure is that they do not provide, in combination with the other features and advantages disclosed herein, a flameless candle with integral fountain to which a pleasing fragrance can easily be added or removed.

A still further problem associated with devices that precede the present disclosure is that they do not provide, in combination with the other features and advantages disclosed herein, a flameless candle with integral fountain that is simple and inexpensive to manufacture.

There is a demand, therefore, to overcome the foregoing problems while at the same time providing a flameless candle with integral fountain that is safely portable and self-contained, yet is easy, safe and convenient to operate in a variety of modes, while also reliable and simple to manufacture, thereby providing users with a safe and beautiful decorative device.

SUMMARY OF THE INVENTION

In a preferred embodiment, the flameless candle with integral fountain disclosed herein provides a decorative display apparatus combining the appearance of a traditional wax candle with the sound and appearance of a fountain in a self-contained, portable unit. The decorative display apparatus has a wax outer sheath. The wax outer sheath may itself comprise an upper, water tight, water reservoir chamber containing a water pump, a light source, and an integrated water and light diffuser. The decorative display apparatus also has a lower compartment contained in the wax sheath that holds both a power source and switch mechanism.

In a further preferred embodiment, the upper chamber may optionally be sealed with a water tight clear cover to provide enhanced safety and portability, while retaining the appearance of a wax candle combined with a fountain.

In a further preferred embodiment, the upper, water tight reservoir chamber further comprises a clear, water tight liner that is sealed to the inner surface of the wax outer sheath with an upper annular gasket. If the upper water tight liner is used, the lower compartment is also sealed to the inner surface of the wax outer sheath with a lower annular gasket. The upper annular gasket is constructed and arranged to cooperate with rims located on the inner portion of the wax outer sheath and the outer portion of the upper water tight liner to prevent water from seeping into the space between the wax outer sheath and the watertight liner, if the upper chamber is not sealed with the optional water tight clear cover. The inside of the lower portion of the wax outer sheath has an inward lip that cooperates with an inward flange on the lower gasket so that even if water does seep into the space between the wax outer sheath and the lower compartment, the water will not spill out the bottom of the decorative display apparatus. The inward lip on the inside of the lower portion of the wax outer sheath is added after the upper inner liner and lower compartment are slid into place in the inside on the outer wax sheath. Thus, the inward lip on the lower portion of the wax outer sheath also serves to hold the upper liner and lower compartment in place inside the wax outer cylinder. The inward lip on the lower portion of the wax outer sheath further is located such that the lower compartment is held in place above a surface upon which the decorative display apparatus rests. In addition to the water tight seal, both upper and lower gaskets further provide dimensional flexibility between the wax outer sheath and the upper water tight liner and lower compartment. This dimensional flexibility prevents the wax sheath from cracking if it gets cold and contracts.

In another preferred embodiment, there is no upper liner and therefore no upper annular gasket, but the lower compartment is provided with the lower annular gasket that provides a water tight and dimensionally flexible seal between the lower compartment and the outer sheath.

In a still further preferred embodiment, the lower compartment is clear, so that light from the light source contained in the upper chamber is also emitted from the lower portion of the decorative display apparatus.

In a more preferred embodiment, the flameless candle with integral fountain is provided with a brushless submersible water pump, LEDs as the light source and is optionally powered by batteries or an external source of power, e.g.; a USB port or an AC current source transformed to a DC current supply.

In a still more preferred embodiment, the flameless candle with integral fountain has a remote control feature and a timer in the switch mechanism.

In a yet more preferred embodiment, the flameless candle with integral fountain includes a scented solution in the water reservoir, thereby facilitating production of a pleasant odor.

Thus, it is an object of the present disclosure is to provide, in combination with the other features and advantages disclosed herein, a flameless candle with integral fountain that is sized to be portable and so may be conveniently moved from place to place.

An additional object of the present disclosure is to provide, in combination with the other features and advantages disclosed herein, a flameless candle with integral fountain that does not need to be operated near an electrical outlet, e.g., outdoors.

Another object of the present disclosure is to provide, in combination with the other features and advantages disclosed herein, a flameless candle with integral fountain that retains the external appearance of a traditional wax candle.

Still a further object of the present disclosure is to provide, in combination with the other features and advantages disclosed herein, a flameless candle with integral fountain that combines in a single unit the decorative features of both a traditional wax candle and a fountain.

Another object of the present disclosure is to provide, in combination with the other features and advantages disclosed herein, a flameless candle with integral fountain that is optionally provided with a sealed water tight clear top cover so that safety and portability are enhanced, while still proving the appearance and sound of a traditional fountain.

Still another object of the present disclosure is to provide, in combination with the other features and advantages disclosed herein, a flameless candle with integral fountain that is provided with an upper clear inner water tight liner to provide improved water tightness and therefore improved portability and safety.

A further object of the present disclosure is to provide, in combination with the other features and advantages disclosed herein, a flameless candle with integral fountain that is provided with annular gaskets between an outer wax sheath and the upper clear inner water tight liner and a lower compartment containing a power source and switch mechanism to prevent water seepage and spillage between the wax casing and upper liner and lower compartment.

A still further object of the present disclosure is to provide, in combination with the other features and advantages disclosed herein, a flameless candle with integral fountain that may be operated as a flameless candle only or as a combination flameless candle with an integral water fountain.

Yet another object of the present disclosure is to provide, in combination with the other features and advantages disclosed herein, a flameless candle with integral fountain that is optionally remote controlled.

Still a further object of the present disclosure is to provide, in combination with the other features and advantages disclosed herein, a flameless candle with integral fountain that may be optionally powered either with onboard batteries or with an external power source, e.g., an AC current source transformed to a DC current supply.

Still another object of the present disclosure is to provide, in combination with the other features and advantages disclosed herein, a flameless candle with integral fountain that is safe to operate due to illumination provided with electrically powered lighting, rather than an open flame.

Yet another object of the present disclosure is to provide, in combination with the other features and advantages disclosed herein, a flameless candle with integral fountain that is optionally sealed at the top so that it can conveniently and safely be moved without danger of spilling the liquid and to safeguard children and pets from exposure to the liquid.

Another object of the present disclosure is to provide, in combination with the other features and advantages disclosed herein, a flameless candle with integral fountain that is provided with a timer to turn it off automatically.

A still further object of the present disclosure is to provide, in combination with the other features and advantages disclosed herein, a flameless candle with integral fountain that is comprised of standard "off the shelf" components, thus rendering it simple and inexpensive to manufacture.

The following disclosure describes a flameless candle with integral fountain that provides the foregoing advantages while at the same time is attractive, safe, may conveniently be moved, and is usable in any location, indoors or outdoors.

In brief, the disclosure provides a self-contained flameless candle with an integrated water fountain. The candle is a suitable size and weight such that it may be conveniently moved. The candle comprises an outer cylindrical decorative sheath, manufactured preferably of a translucent material such as plastic, wax or glass, or a combination of such materials, being shaped and colored to resemble a traditional wax candle.

The candle also further comprises two connected but independent sections: a lower section, defined as the lower chamber, holding both the power source and switch mechanism; and an upper section for the water reservoir chamber, which may also comprise a water tight liner. The outer cylindrical decorative sheath is constructed and arranged to fit around the lower chamber and upper water tight liner. If the optional water tight liner is used, an upper gasket and a lower gasket are used to ensure tight, waterproof, yet flexible seals between the outer decorative sheath and the water tight liner and the lower chamber. If used, the upper water tight liner should be comprised of a water tight transparent or translucent material, such as plastic. The lower chamber should also be constructed of a suitable water tight material such as plastic, and may be transparent, translucent or opaque. If the lower compartment is transparent or translucent, the candle will appear to glow on the bottom as well as the top, when its light is on. The lower compartment may be provided with the lower annular gasket, even if the upper water tight liner and upper annular gasket are not used.

An optional sealed cover is also provided. If both the optional cover and the optional upper water tight liner are used, the cover is sealed to the upper liner. This cover, if used, is preferably constructed of a suitable transparent material such as plastic. If the upper water tight liner is omitted, the cover is sealed to the top of the cylindrical sheath.

The gaskets, mentioned briefly above, serve dual purposes. The first is preventing water seepage and spillage between the outer sheath and the inner liner and lower compartment if the optional cover is not used, thus preventing water from spilling onto the surface where the decorative display apparatus is placed. The second purpose of the gaskets is to provide a dimensionally flexible seal between the outer decorative sheath and both the upper liner and the lower compartment which prevents the outer sheath from cracking due to temperature changes. The gaskets, upper liner, lower chamber and outer sheath are constructed and arranged to work together to provide a water tight, yet dimensionally flexible seal that further works to hold the upper liner and lower compartment securely in place inside the outer sheath. Additionally, the lower compartment is held in place with a circumferential lip on the inside of the outer sheath. This lip is located a distance above the very bottom of the outer sheath so that the lower compartment does not touch a surface that the decorative apparatus is placed on.

The upper water reservoir chamber (whether lined or not) contains a submersible, dry run brushless pump, a watertight lighting assembly and a water and light diffuser. The pump is constructed and arranged so that it will automatically switch off when the water level in the reservoir drops below a predetermined level, thereby protecting the pump. The lower chamber contains a switch and power source cabinet. The upper surface of the lower chamber defines the floor of the water reservoir. The pump is fixedly mounted to the floor of the water reservoir chamber and pumps water up through a vertical nozzle to create the fountain effect.

The water and light diffuser comprises a translucent disk, made of a suitable waterproof, translucent or transparent material such as glass, plastic or wax or a combination of such materials. The water and light diffuser is located above the water level of the water reservoir and is mounted circumferentially around the top of the vertical nozzle. The water and light diffuser serves to guide the water emerging from the top of the vertical nozzle outwardly in a generally horizontal direction before the water cascades over the edge of the water and light diffuser, creating the fountain effect.

In an alternative embodiment, a flow diverter rib is provided on the underside of the water and light diffuser. This maintains the ability of the diffuser to have water drop straight down from it when flowrates are reduced, thereby extending the ability of the fountain to maintain a waterfall sound and lighted flicker effect with diminishing battery voltage level, as when the fountain is nearing a need for either battery replacement or, if the batteries are rechargeable, for a battery recharge.

The lighting assembly is also mounted circumferentially around the vertical nozzle emerging from the pump. The lighting assembly may be located above or below the water level in the water reservoir, but must be located below the water and light diffuser, such that the water and light diffuser is illuminated from below. Further, the lighting assembly is located above the pump. Because the water and light diffuser is comprised of a translucent material, when lit from below by the lighting assembly, it provides a flame effect.

The two chambers, upper and lower, are in wired communication, via a watertight seal, such that power and electronic control may be sent from the lower chamber to the upper chamber without water leaking into the lower chamber. The water and light diffuser is configured such that water from the reservoir is pumped up through its center and allowed to cascade decoratively over it, falling freely downward and thus back into the reservoir, creating a fountain effect. For the embodiment containing the optional flow diverter rib, referred to briefly above, the water may also come in contact with the diverter rib before falling freely downward, depending on the flowrate the existing battery power facilitates.

The lighting assembly is positioned below the water and light diffuser and aimed upwards to illuminate the underside of the water and light diffuser, thus creating a flame effect. The lighting assembly is waterproof and may comprise, for instance, LED lights. Electronic control of the lights may produce a rapid on-off effect, thus contributing to the flickering flame effect. Control switches are provided such that the flameless candle may be operated with either the flame effect alone or as a flameless candle combined with the water fountain effect. A timer is provided to automatically turn off the flameless candle.

Optionally, scent may be added to the open water reservoir, such that a pleasing scent is emitted.

If the optional cover is used, glycerin or other suitable antifreeze agent is added to the water, to prevent the water freezing and cracking the device if the device is exposed to temperatures below the freezing point of water. Further, if the optional cover is provided, an optional hole fitted with a plug is provided on the bottom of the upper chamber so that the flameless candle may be conveniently filled with the water and glycerin mixture.

BRIEF DESCRIPTION OF THE DRAWINGS

In the detailed description that follows, reference will be made to the following figures:

FIG. 3(*b*) is cross-sectional view of a portion of a preferred embodiment of the disclosure, showing the upper annular gasket in position;

FIG. 4(*b*) is a cross-sectional view of a portion of a preferred embodiment of the disclosure, showing the lower annular gasket in position;

FIG. 14(*b*) is an illustration of a more preferred embodiment of the disclosure showing an optional flow diverter rib; and FIG. 14(*c*) is an illustration of the more preferred embodiment of the disclosure showing the effect of diminished battery power on the flow pattern of water in the apparatus when the flow diverter rib is in place.

DETAILED DESCRIPTION OF PREFERRED EMBODIMENTS

The following discussion refers to FIGS. 1 through 14. Various preferred embodiments are shown and it is understood that some parts are the same for various embodiments and that these part numbers are the same for various views of the alternate embodiments.

Figure 1:
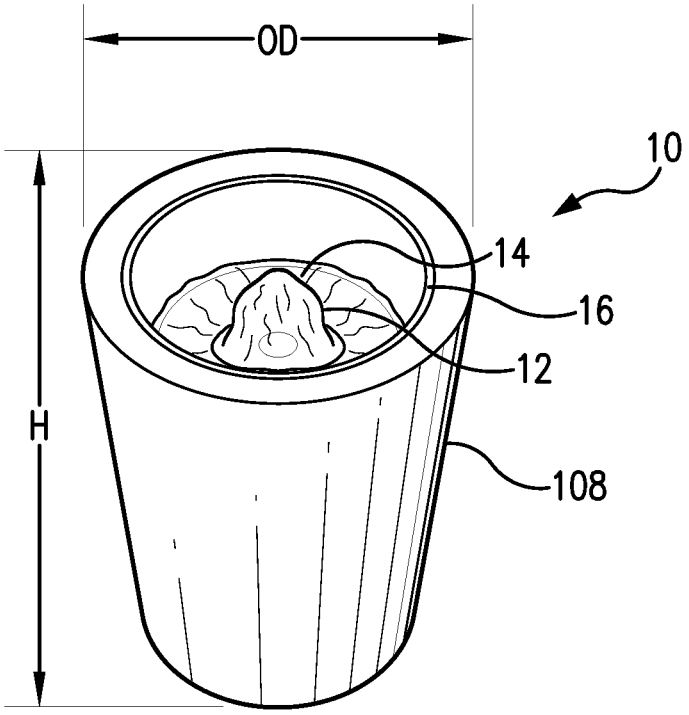
FIG. 1 is a perspective view of a preferred embodiment of the disclosure.

FIG. 1 illustrates a perspective view of a preferred embodiment of a decorative display apparatus 10 comprising a flameless candle with integral fountain. The apparatus 10 provides a fountain assembly 12 and a flame assembly 14 which are, in operation, visible from the top of the apparatus 10. As shown in FIG. 1, the decorative display apparatus 10 is generally cylindrical in shape having a height H and an outer diameter OD. In a preferred embodiment, H is between about 6 inches and about 10 inches, and most preferably about 8 inches. Likewise, OD is between about 4 inches and about 6 inches, and most preferably about 5 inches.

Figure 2:
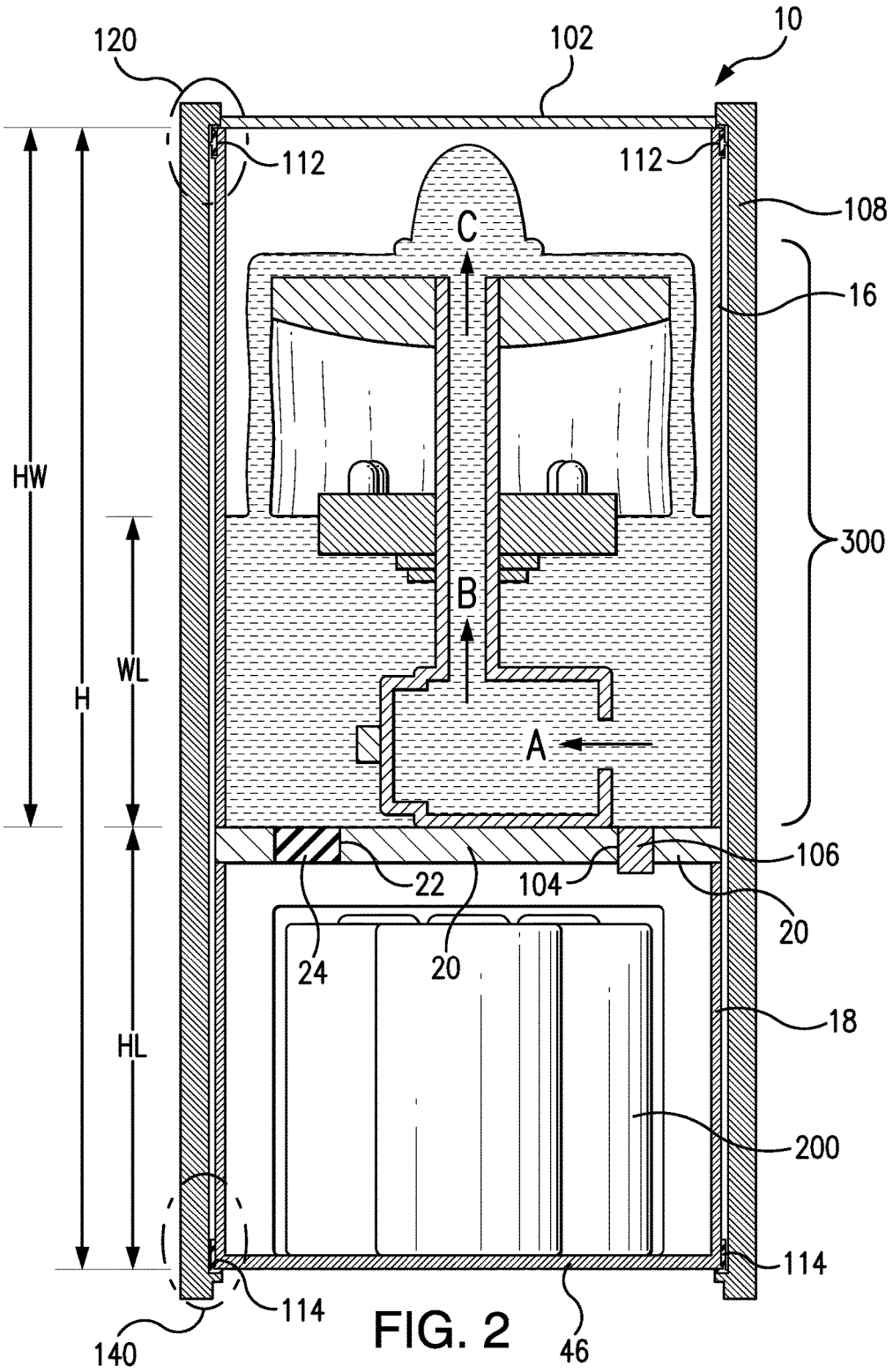
FIG. 2 is a cutaway side view of a preferred embodiment of the disclosure.

FIG. 2 illustrates a cross section of a more preferred embodiment of the decorative display apparatus 10 in operation. The decorative display apparatus 10 comprises an optional upper reservoir liner 16, a lower chamber 18, an outer decorative sheath 108, an optional transparent sealed cover 102, a power/switch module 200 and a fountain/lighting module 300. The upper reservoir chamber 16, if used, enhances the water tightness of the apparatus 10, thus improving safety and portability. The optional transparent sealed cover 102 also improves safety and portability of the apparatus 10 by preventing water from spilling when the apparatus 10 is moved and also preventing access by children and pets to the water and the fountain/lighting module 300.

The outer decorative sheath 108 is manufactured preferably of a translucent material such as plastic, wax or glass, or a combination of such materials, and is shaped and colored to resemble a traditional wax candle. The outer decorative sheath 108 is constructed and arranged to fit around the upper reservoir liner 16, and the lower chamber 18. An upper annular gasket 112 and a lower annular gasket 114 are used to ensure a tight, waterproof, yet flexible seal between the outer decorative sheath 108 and the upper reservoir liner 16 and the lower chamber 18, respectively. This seal prevents water leaking into the space between the outer decorative sheath 108 and the upper reservoir liner 16 and the lower chamber 18, if the optional transparent sealed cover 102 is not used. The lower annular gasket 114 further prevents any water from leaking onto any surface that the decorative display apparatus is placed. In addition, the gaskets 112 and 114 provide a dimensionally flexible seal between the outer and the upper reservoir liner 16 and the lower chamber 18 such the outer decorative sheath 108 will not crack if the apparatus 10 is exposed to temperatures that cause the outer decorative sheath 108 to shrink more than the upper reservoir liner 16 and the lower chamber 18.

It is important to emphasize that the optional transparent sealed cover 102 may be used with either the embodiment including the upper reservoir liner 16 or the embodiment that does not include the upper reservoir liner 16. The optional transparent cover 102 may be sealed either to the top of the outer sheath 108 or to the top of the upper reservoir liner 16.

Figure 3A:
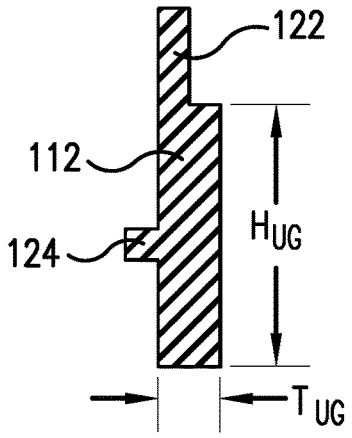
FIG. 3(*a*) is a cross-sectional view of a portion of a preferred embodiment of the disclosure, showing an upper annular gasket.
Figure 3B:
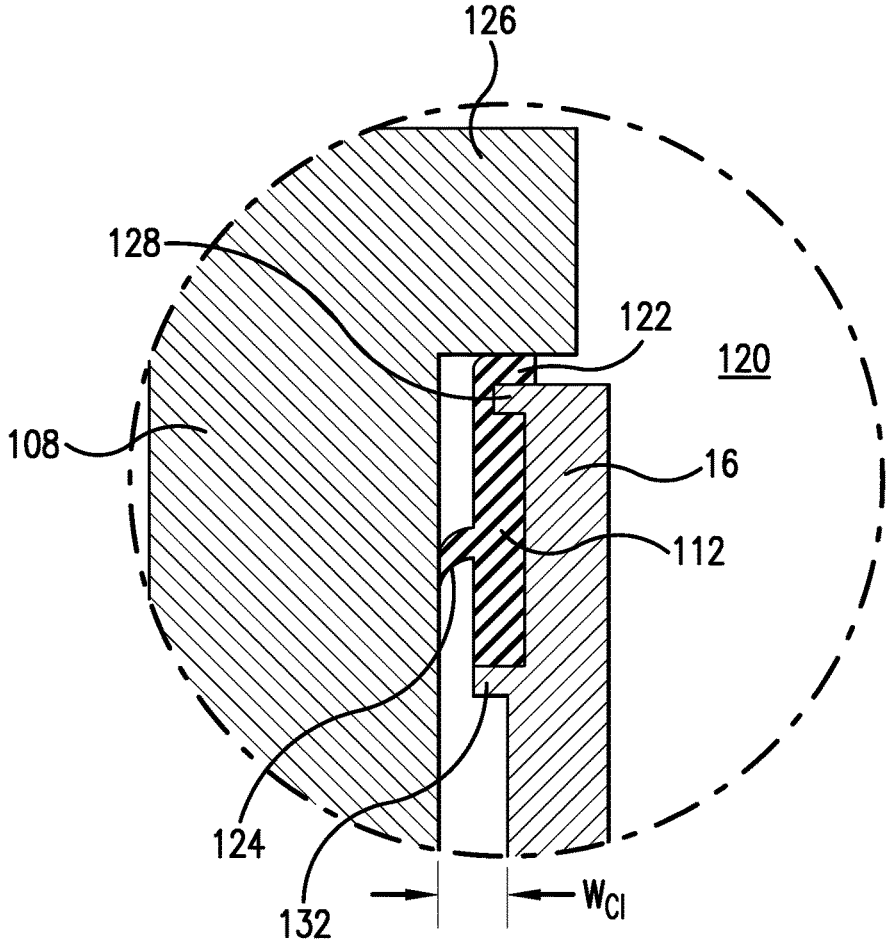

If used, the upper annular gasket 112 is located in an upper sealing region 120 and is shown in more detail in FIGS. 3(*a*) and 3(*b*). If used, the lower annular gasket 114 is located in a lower sealing region 140 and is shown in more detail in FIGS. 4(*a*) and 4(*b*). The details of the upper sealing region 120 and the lower sealing region 140 and upper and lower gaskets 112 and 114 are exactly the same for each embodiment of apparatus 10 in which they are used.

Figure 5:
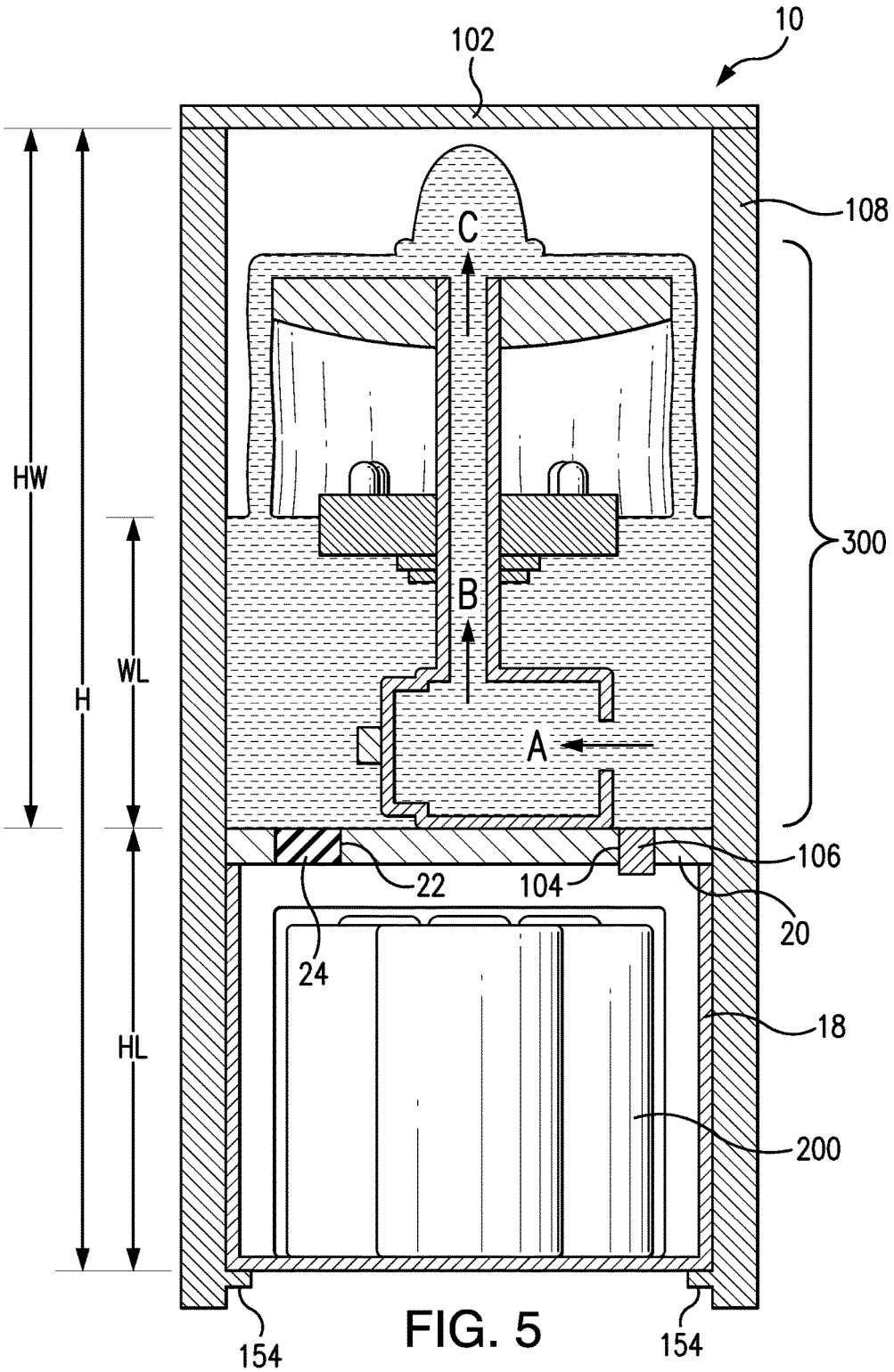
FIG. 5 is a schematic, cutaway side view of a preferred embodiment of the disclosure.

FIG. 5 shows an embodiment in which the upper reservoir liner 16 and the upper and lower annular gaskets 112 and 114 are omitted, but the sealed transparent cover 102 is used.

Figure 6:
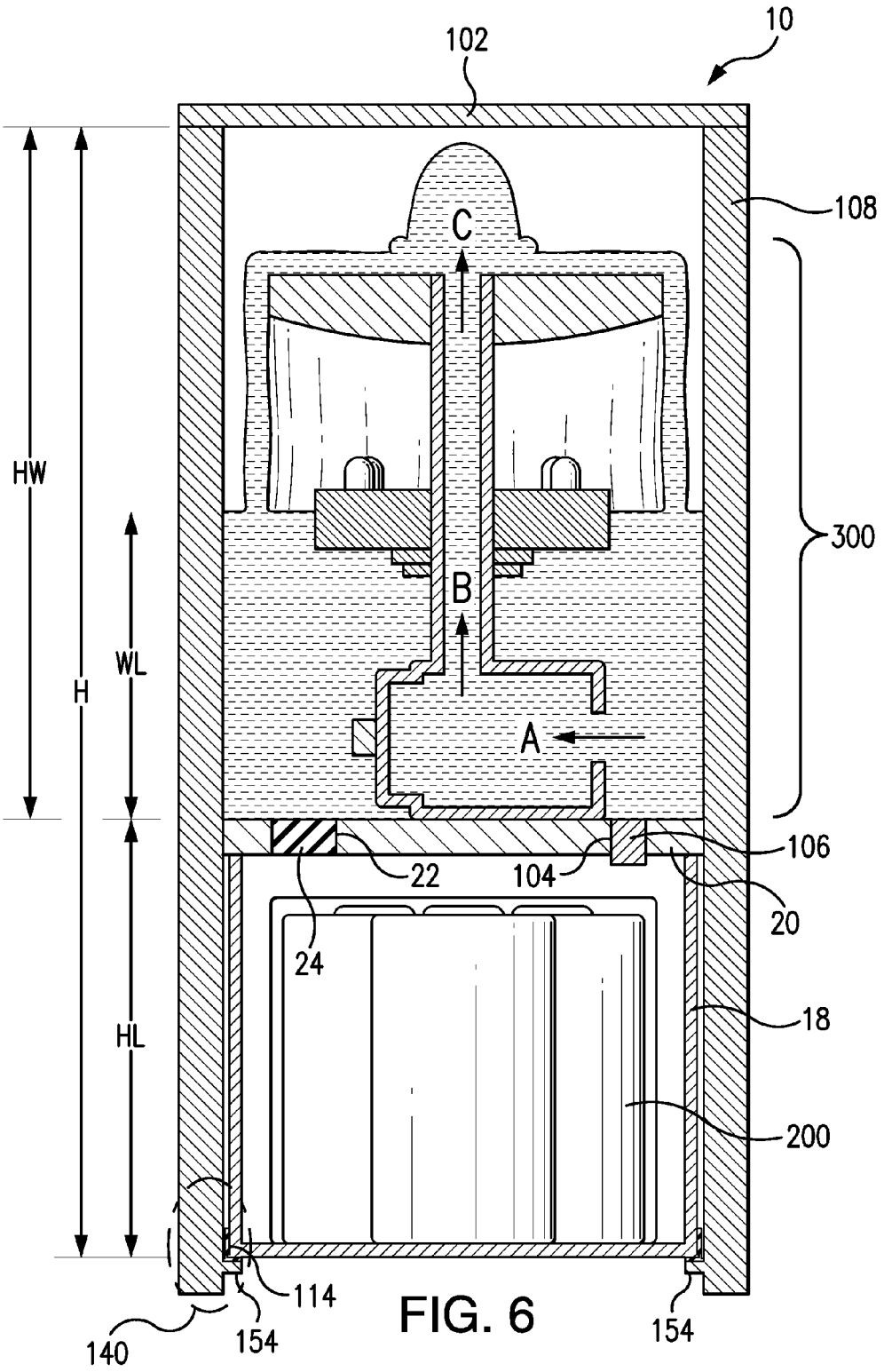
FIG. 6 is a schematic, cutaway side view of a preferred embodiment of the disclosure showing an embodiment that has only the lower annular gasket.

FIG. 6 shows another embodiment, similar to the embodiment of FIG. 5, but in this embodiment, the lower annular gasket 114 is used to seal the lower chamber to the inside of the outer sheath 108. In the embodiment shown in FIG. 6, the upper reservoir liner 16 is not used. Note that in FIG. 6, the optional transparent cover 102 is shown, but it could be omitted.

If the upper reservoir liner 16 is used, as shown in FIG. 2, it should be translucent or clear so that it transmits light to the translucent outer sheath 108 and thus the upper part of the outer sheath 108 will glow. The upper reservoir liner 16 is manufactured out of any suitable rigid water-proof material such as plastic.

The lower chamber 18 may be translucent, clear or opaque. If the lower chamber 18 is translucent or clear, it will transmit light to the translucent outer sheath 108, such that the lower portion of the outer sheath 108 will glow. The lower chamber 18 is manufactured out of any suitable rigid water-proof material such as plastic.

Looking more closely at FIG. 2, the upper reservoir liner 16 and the lower chamber 18 are connected but separate. The upper reservoir liner 16 is positioned above the lower chamber 18. The upper reservoir liner 16 has a height HW, preferably between about 3 inches and 12 inches, and more preferably between about 4 inches and 6 inches; ideally, HW is about 5 inches. The lower chamber 18 has a height HL of between about 1 inch and about 4 inches, and more preferably between about 2.5 inches and about 3.5 inches; ideally, HW is about 3 inches. The lower chamber 18 has a bottom piece 46. (The bottom piece 46 is shown in more detail in FIG. 11.)

Water or some other suitable fluid is contained in the upper reservoir liner 16 and the liquid level therein is indicated by WL. The water or other suitable liquid may be scented, as more fully explained below. If the optional sealed cover 102 is used, the water or other suitable fluid may be mixed with an antifreeze agent, also discussed below. The antifreeze nature of the fluid is intended to prevent the fluid from freezing in the event that the apparatus 10 is exposed to temperatures below the freezing point of the fluid.

The upper reservoir liner 16 and lower chamber 18 are separated by a divider 20. Divider 20 is provided with a throughhole 22 to provide wired communication between the optional upper reservoir liner 16 and the lower chamber 18. Throughhole 22 is provided with a seal 24, constructed and arranged so that wires may pass from the lower chamber 18 to the upper reservoir liner 16, but liquid is prevented from leaking into the lower chamber 18 from the upper reservoir liner 16. The seal 24 may comprise, for example, a grommet or a suitable caulking or potting material, or a combination of such elements.

As mentioned briefly above, the decorative display apparatus 10 shown in FIG. 2 may further have an optional transparent cover 102. This optional transparent cover 102 is comprised of a suitable rigid transparent material such as plastic and is sealed to the top of the upper reservoir liner 16 in any suitable watertight fashion. Methods of sealing may comprise, but are not limited to such methods as glue, welding, threadable connections, etc.

If the top of the upper reservoir liner 16 is sealed with the optional transparent cover 102, the divider 20 is further provided with an optional fill hole 104, so that the upper reservoir liner 16 may be filled from below with a suitable fluid. After filling the upper reservoir chamber 16, the optional fill hole 104 is sealed with a plug 106. The plug 106 may be comprised of any suitable material such as plastic, rubber or silicone or any elastomer that has Shore A hardness between 55-95. The preferred embodiment has Shore A hardness of 70. If the optional transparent cover 102 is used, a liquid that has a freezing point below that of water is preferred as the fluid. Examples of such fluids may comprise but are not limited to distilled water/glycerin mixtures ranging from 0 to 65 percent glycerin by weight. The preferred embodiment comprises 60% glycerin by weight.

Referring now to FIGS. 3(*a*) and 3(*b*), the upper sealing region 120 (FIG. 2) is shown in cross-section in more detail. FIG. 3(*a*) shows the cross-section of upper annular gasket 112 before it is stretched into place around the upper outer circumference of upper reservoir 16 and FIG. 3(*b*) shows a cross-section of the upper annular gasket 112 in position in upper sealing region 120. The upper annular gasket 112 is manufactured of a suitable extendable, compressible elastomeric material such as rubber or silicone having a Shore A hardness between 55 and 95. Shore A hardness between 65 and 75 is more preferred and Shore A hardness of 70 is most preferred. The upper annular gasket 112 is generally rectangular in cross-section, having height $H_{UG}$ and thickness $T_{UG}$. $H_{UG}$ ranges from 5 to 10 mm and is preferably about 7 mm. $T_{UG}$ ranges from 1 to 3 mm and is preferably about 2 mm. The upper annular gasket 112 also has two sealing flanges, an upward flange 122 and an outward flange 124.

As can be seen in FIG. 3(*b*), the upper annular gasket 112 is interposed between the outer sheath 108 and the upper reservoir liner 16. The purpose of upper annular gasket 112 is to provide a flexible, water tight seal between the upper reservoir liner 16 and the outer sheath 108. The outer sheath 108 has a circumferentially located inward rim 126 and the upper reservoir chamber 16 has a circumferentially located outward rim 128. When the upper annular gasket 112 is in place between the outer sheath 108 and the upper reservoir liner 16, the upward flange 122 bends inward and is compressed between the inward rim 126 and the outward rim 128, forming a water tight seal between the upper reservoir liner 16 and the outer sheath 108. The upward flange 122 is preferably compressed between 10% and 40% for optimum sealing.

Also shown in FIG. 3(*b*) the upper reservoir liner 16 has a circumferential outer lip 132. The outer lip 132 is spaced apart from the outward rim 128 a distance $H_{UG}$ so that the upper annular gasket 112 fits snugly into the space therebetween. The outward flange 124 fits tightly against the inner surface of outer sheath 108, such that it is compressed and bent slightly up or down against the inner surface of outer sheath 108, thus forming another flexible water tight seal between outer sheath 108 and upper reservoir 16. This seal is not only water tight, but also provides dimensional flexibility so that if the outer sheath 108 is exposed to cold and shrinks more than the upper reservoir liner 16, the outer sheath 108 will not crack.

When upper annular gasket 112 is in place, there is a clearance of width $W_{cl}$ between the outer sheath 108 and the upper reservoir liner 16. $W_{cl}$ ranges from 0.25 to 1 mm and is most preferably about 0.5 mm. Acting together, the upward flange 122 and outward flange 124 prevent water seeping into the clearance between the outer sheath 108 and the upper reservoir liner 16, if the optional sealed cover 102 is not used.

Figure 4A:
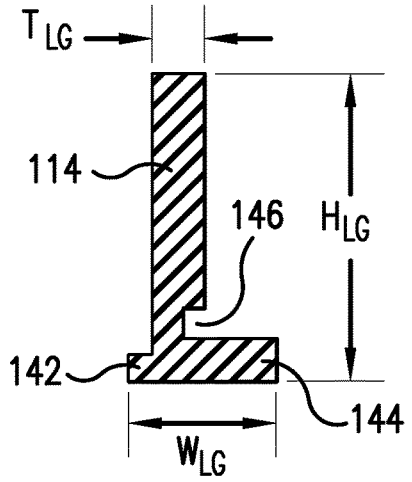
FIG. 4(*a*) is a cross-sectional view of a portion of a preferred embodiment of the disclosure, showing a lower annular gasket.
Figure 4B:
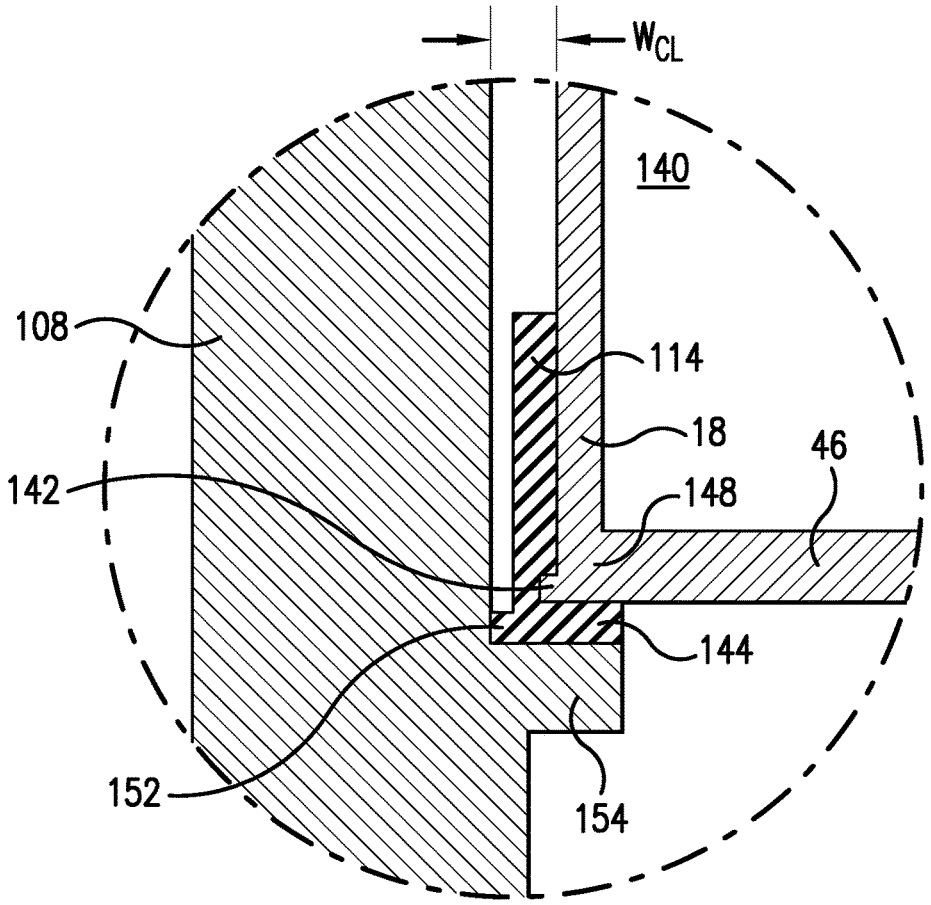

Referring now to FIGS. 4(*a*) and 4(*b*), the lower sealing region 140 (FIG. 2) and the lower annular gasket 114 are shown in cross-section. FIG. 4(*a*) shows in cross-section, the lower annular gasket 114. The lower annular gasket 114 is manufactured of a suitable extendable, compressible elastomeric material such as rubber or silicone having a Shore A hardness between 55 and 95. Shore A hardness between 65 and 75 is more preferred and Shore A hardness of 70 is most preferred. Lower annular gasket 114 is generally L-shaped, having height $H_{LG}$, thickness $T_{LG}$ and width $W_{LG}$. $H_{LG}$ ranges between 10 and 20 mm and preferably is about 15 mm. $T_{LG}$ ranges between 1 and 5 mm and preferably is about 3 mm. $W_{LG}$ ranges between 5 and 10 mm and preferably is about 7 mm. The lower annular gasket 114 has an outward flange 142 located circumferentially on the outside of its lower edge. Opposite the outward flange 142 is an inward flange 144, located circumferentially on the inside of its lower edge. This inward flange 144 forms the bottom of the L-shape. Located above the inward flange 144 is a circumferential notch 146.

Turning now to FIG. 4(*b*), the lower annular gasket 114 is shown in position between the outer sheath 108 and a corner 148 formed by the lower chamber 18 and the bottom piece 46. An outward rim 148 extends circumferentially around the outside of the corner 148. This outward rim fits tightly into the notch 146, forming a water tight seal between the outer sheath 108 and the lower chamber 18. An inward lip 154 extends circumferentially around the inside of outer sheath 108. The outward flange 142 and inward flange 144 seat on the inward lip 154, also forming a water tight seal between the outer sheath 108 and the lower chamber 18. The inward lip 144 is preferably compressed between 10% and 40% in order to provide an optimal water tight seal. These two water tight seals act together to prevent any water located in the space of width $W_{CL}$ between the lower chamber 18 and the outer sheath 108 from leaking onto a surface that the decorative display apparatus 10 is placed. This feature is important for the embodiment without the optional sealed transparent cover 102 because without the sealed cover 102, it is much more likely that water could get into the space between the lower chamber 18 and the outer sheath 108.

Another important feature of the inward lip 154 is that it is applied to the inside of the outer sheath 108 after the upper chamber 16 (if used), the fountain/lighting module 300 and the lower compartment 18 (containing the power/switch module 200) are slid up into place from the bottom into the outer sheath 108. Thus, the inward lip 154 also serves to lock interior components of the decorative display apparatus 10 into the outer sheath 108. Further, the inward lip 154 is located a distance up from the very bottom of the outer sheath 108, so that the bottom 46 of the lower chamber 18 does not touch a surface upon which the decorative display apparatus is placed.

FIG. 5 shows an alternate embodiment of the decorative display apparatus 10, in which the upper reservoir liner 16 is omitted, as are the upper and lower annular gaskets 112 and 114. In this embodiment the divider 20 is fixed in a water tight fashion to the interior of the outer sheath 108, and the transparent sealed cover 102 is sealed to the top of the outer sheath 108 in any suitable water tight fashion. Methods of sealing may comprise, but are not limited to such methods as glue, welding, threadable connections, etc. As described above for the embodiment using the upper reservoir liner 16, the divider 20 has the fill hole 104, which is sealed with the plug 106. For this embodiment, a liquid that freezes below the freezing point of water is preferred as the fluid. Examples of such fluids may comprise but are not limited to mixtures of glycerin and distilled water ranging from 0 to 65 percent glycerin by weight. A mixture comprising 60% glycerin by weight is preferred.

Also shown in FIG. 5 is the inward lip 154 which extends circumferentially around the inside of outer sheath 108. Even though there is no lower annular gasket 114 in the embodiment shown in FIG. 5, the inward lip 154 is located a distance up from the very bottom of the outer sheath 108 and is added after the lower compartment 18 is slid into place. Therefore in this embodiment, the lip 154 serves the purposes of 1) locking the lower compartment 18 into place and 2) ensuring that the bottom 46 of the lower chamber 18 does not touch a surface upon which the decorative display apparatus is placed.

FIG. 6 shows another alternate embodiment of the decorative display apparatus 10, similar to FIG. 5 in that the upper reservoir liner 16 is omitted. In this embodiment, unlike the FIG. 5, embodiment, the lower annular gasket 114 is used to provide a seal between the lower chamber 18 and the outer sheath 108. In FIG. 6, note that the optional cover 102 and optional fill hole 104 and optional plug 106 are shown. It is understood that the transparent cover 102 and also fill hole 104 and plug 106 may be omitted for an embodiment in which the lower gasket 114 is used, but the transparent cover 102 is not.

Figure 7:
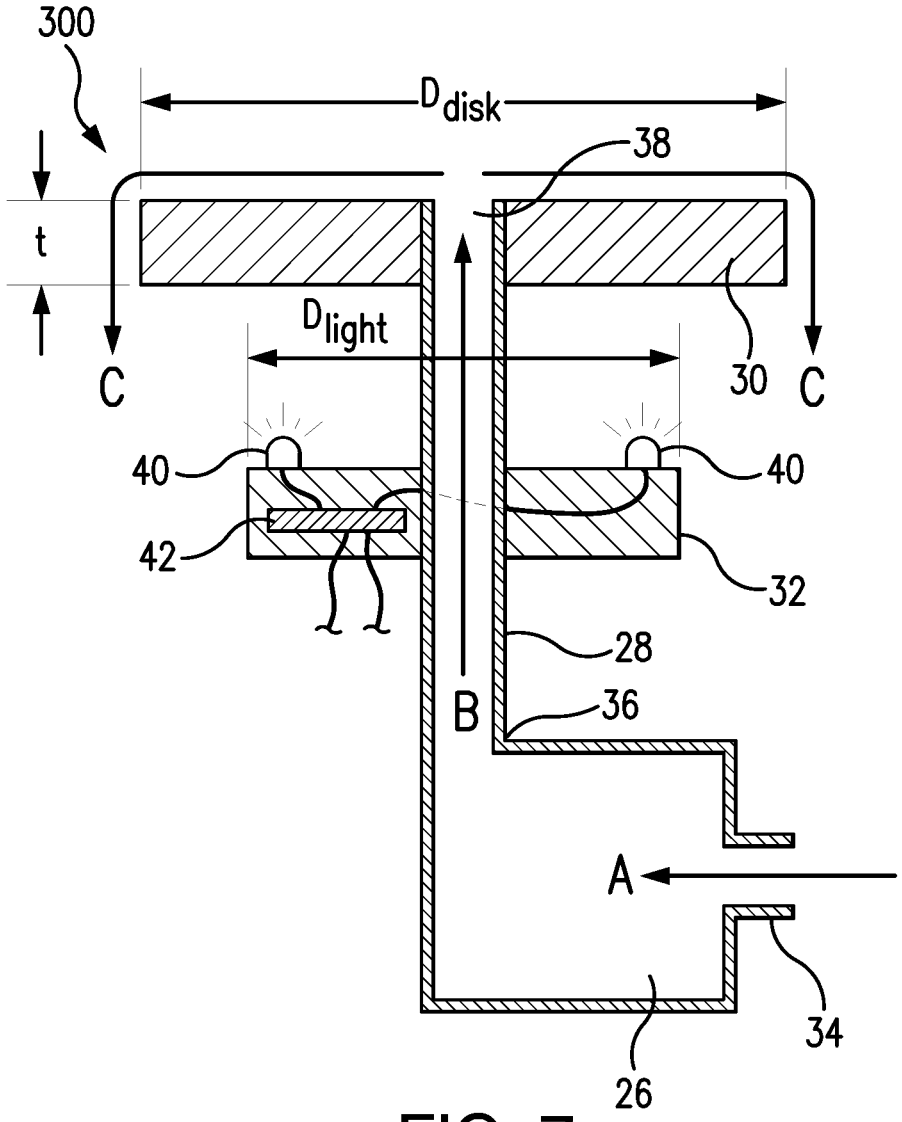
FIG. 7 is a schematic perspective view of a portion of a preferred embodiment of the disclosure.

Referring now to FIG. 7, a cross-section of the fountain/lighting module 300 is shown. The fountain/lighting module 300 is positioned in the upper reservoir liner 16 (FIG. 2) if it is used or in the upper chamber, if the liner 16 is not used (FIGS. 5 and 6). The fountain/lighting module 300 comprises a submersible pump 26, located below the preferred water level WL (shown in FIG. 2), a vertical annular water conduit 28, a water/light diffuser disk 30 and a lighting cabinet 32.

The pump 26 may be of any suitable type and preferably is brushless and equipped with dry-run technology such that it automatically switches off if the water level in the upper reservoir liner 16 is too low.

The water/light diffuser disk 30 is a disk of diameter $D_{disk}$ and thickness t. The diameter $D_{disk}$ is about 3 inches to about 3.5 inches, and preferably about 3.25 inches. The thickness t is about 3/16 inch to about 5/16 inch, and is preferably about 1/4 inch. The water/light diffuser disk 30 may be made of any suitable translucent water-resistant material comprising, for instance, glass, plastic or wax or a combination. Preferably the water/light diffuser disk 30 is comprised of plastic, with a wax coating on its upper surface. The water/light diffusion disk 30 is mounted circumferentially at the upper end of vertical annular water conduit 28. The water/light diffusion disk 30 is located above the water level WL (shown in FIG. 2).

The lighting cabinet 32 is also mounted circumferentially around water conduit 28 and is located above the pump 26 and below the water/light diffusion disk 30. The lighting cabinet 32 may be located above or below water level WL (shown in FIG. 2). The lighting cabinet 32 has diameter $D_{light}$.

The operation is described as follows, referring generally to the presence of water, as this is the most preferred liquid for use. In operation, the path of water circulated by pump 26 is shown schematically by arrows. Water is pumped in (Arrow A) at a pump inlet 34, pumped upward (Arrow B) through pump outlet 36 and further upward through the water conduit 28. The water then emerges at fountain orifice 38, where it cascades over (Arrows C) water/light diffuser disk 30 and back into the upper reservoir liner 16, creating a fountain effect (FIG. 1).

Also shown in FIG. 7 are lights 40 protruding through the top of lighting cabinet 32. The lights 40 may be in any configuration, but preferably are evenly spaced and arranged circumferentially on lighting cabinet 32. The lights 40 illuminate the underside of water/light diffuser disk 30. In a preferred embodiment, between 1 and 5 lights are provided in spaced apart relation disposed about the circumference of the lighting cabinet 32; these are equally spaced apart in the most preferred arrangement. Because the water/light diffuser disk 30 is translucent, both it and the water cascading over it are illuminated, thus creating the flame effect (FIG. 1).

Figure 8:
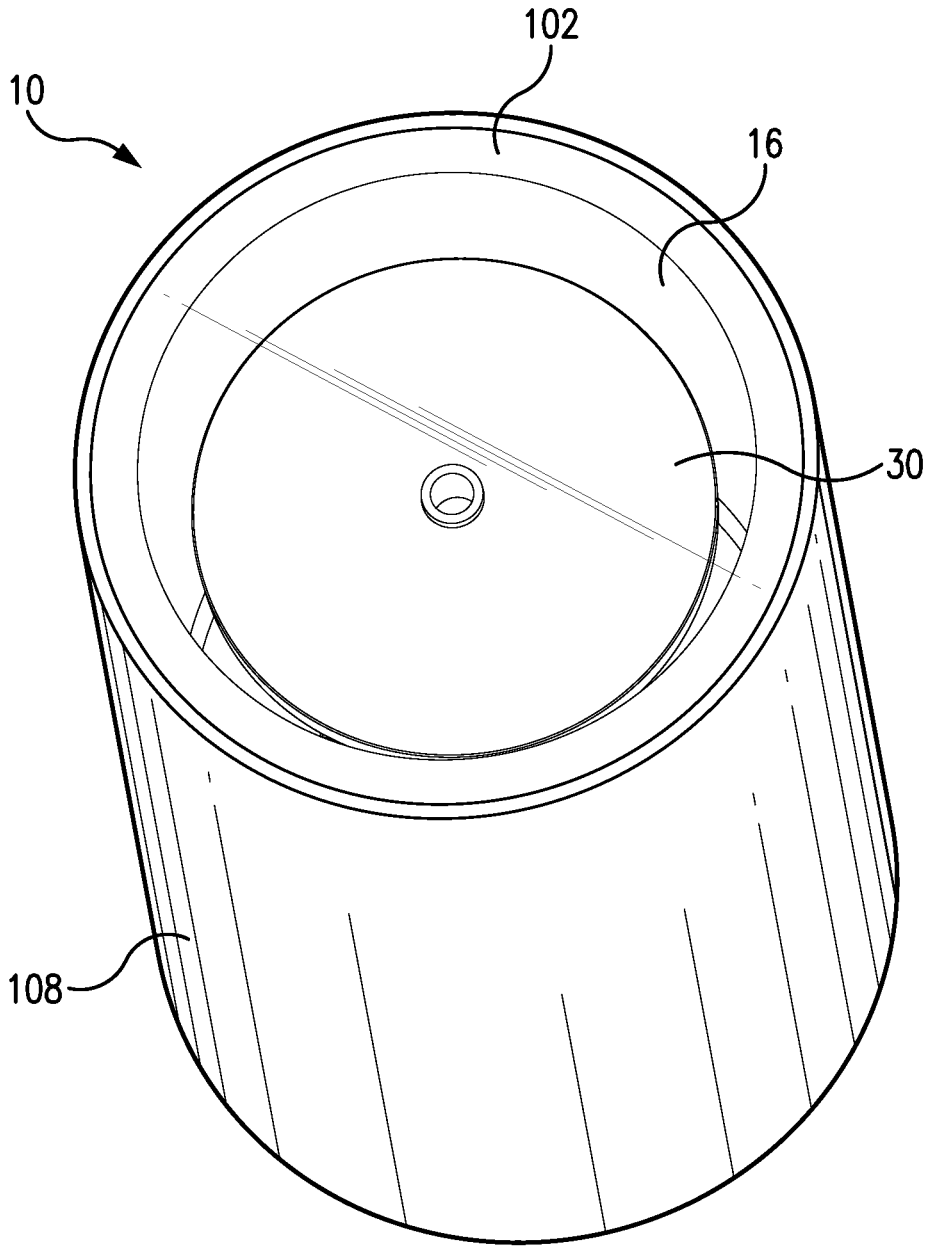
FIG. 8 is a top perspective view of a preferred embodiment of the disclosure.

FIG. 8 is a perspective top view of the apparatus 10 showing the top of water/light diffusion disk 30 located within the upper reservoir liner 16. FIG. 8 also shows the optional transparent sealed cover 102 and the outer decorative sheath 108.

Figure 9:
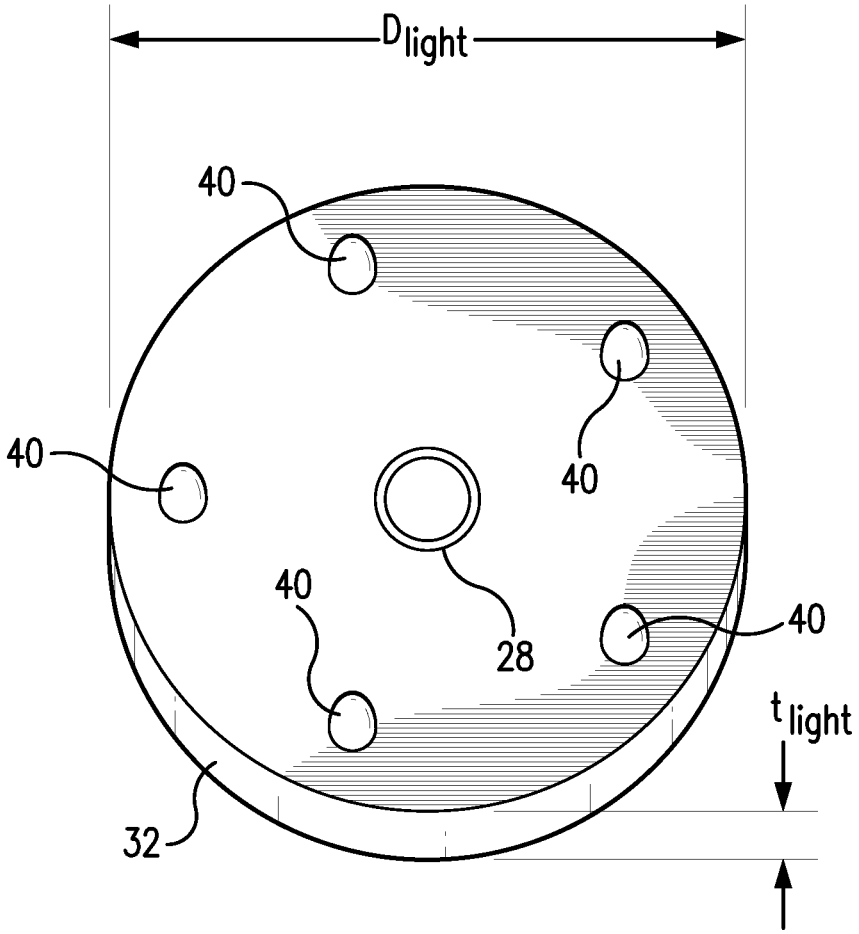
FIG. 9 is a top perspective view of a portion of a preferred embodiment of the disclosure.

FIG. 9 is a top view of the lighting cabinet 32. Lighting cabinet 32 comprises a disk mounted circumferentially around water conduit 28. The lighting cabinet 32 is of diameter $D_{light}$ and thickness $t_{light}$. Diameter $D_{light}$ is preferably between about 2.5 inches and about 3.5 inches, and is more preferably about 3 inches. Thickness $t_{light}$ is preferably about 1/8 inch to about 1/2 inch, and most preferably about 3/8 inch. $D_{light}$ may be smaller or larger than the diameter $D_{disk}$ of water/light diffuser disk 30 (shown in FIG. 7), although preferably $D_{light}$ is smaller than $D_{disk}$.

Lighting cabinet 32 is preferably water tight. Mounted on top of lighting cabinet 32 are lights 40. Lights 40 may be of any suitable type, but are preferably light emitting diodes (LED's). In operation, the lights 40 illuminate the underside of water distribution disk 30, which is translucent or clear, thus creating the flame effect of the apparatus 10.

Shown in cross section in FIG. 7 is a light printed circuit board (PCB) 42 which is mounted within the lighting cabinet 32. Light PCB 42 controls the flickering effect of lights 40, enhancing the flame effect of candle 10.

Figure 10:
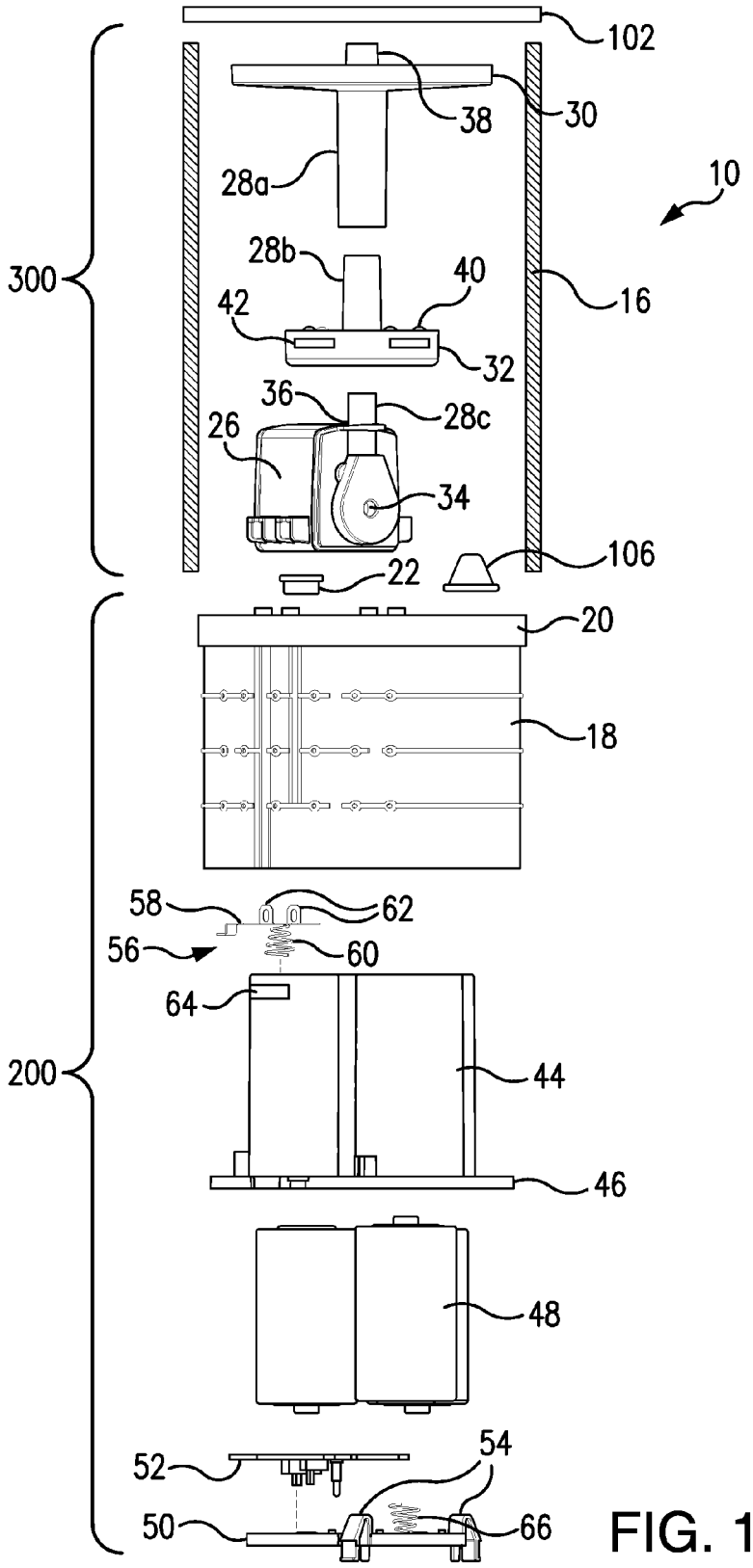
FIG. 10 is an exploded view of a preferred embodiment of the disclosure.

Referring now to FIG. 10, an exploded view of the apparatus 10 is shown without outer sheath 108, illustrating the respective positioning of the various components of a preferred embodiment of the apparatus 10. It can be seen in this exploded view that for ease of assembly of fountain/light module 300, water conduit 28 is comprised of separate pieces, 28*a*, 28*b* and 28*c* that fit together in a water tight fashion. In particular, it can be seen that water conduit piece 28*a* is fixedly attached to, and extends downward from water/light diffuser disk 30. Water conduit piece 28*a* is female and fits in a water tight fashion over male piece 28*b* which is fixedly attached to and extends upward from lighting cabinet 32. Finally, male piece 28*c* is fixedly attached to and extends upward from the output 36 of pump 26 into the bottom of lighting cabinet 32.

Looking now in detail at power/switch module 200, it can be seen that the power/switch module comprises a number of parts. The lower chamber 18 preferably has a cylindrical contour, with the divider 20 fixedly and in water tight relation mounted to its top, which also defines the bottom of water reservoir liner 16. The divider 20 is constructed and arranged so as to be fixedly mounted in a water tight fashion to bottom of the upper reservoir liner 16. The divider 20, may also be comprised of any suitable rigid water tight material such as plastic and may optionally be a separate piece or be molded together with lower reservoir liner 18 or with upper reservoir liner 16.

Also part of power/switch module 200 are a battery housing 44, the bottom piece 46, batteries 48, a removable battery cover 50 and a switch printed circuit board (PCB) 52. The battery housing 44 is constructed and arranged to hold in its interior, the batteries 48. Batteries 48 are understood to be electrically connected to each other, by a suitable means, preferably in series.

Battery housing 44 is further constructed and arranged to fit into lower chamber 18, leaving room for the switch PCB 52. Battery housing 44 may be made of any suitable rigid material such as plastic. Bottom piece 46 is fixedly mounted to the bottom of battery housing 44 and to the bottom of lower chamber 18. Bottom piece 46 is constructed and arranged to receive removable battery cover 50. In this embodiment, removable battery cover 50 is held in place with clips 54.

Also part of the power/switch module 200 is an electrically conductive spring assembly 56. Electrically conductive spring assembly 56 comprises an electrically conductive plate 58. On the underside of conductive plate 58 is fixedly and electrically conductively, attached, e.g. by solder, an electrically conductive spring 60. On the upper side of plate 58 are one or more pliable ears 62. The conductive plate 58 is constructed and arranged to protrude from a slot 64 in the side of battery housing 44. The conductive spring 60 is constructed and arranged to be in electrical contact with one of the batteries 48 and therefore the electrically conductive spring assembly 56 permits electrical energy from batteries 48 to be conducted to the exterior of battery housing 44. The pliable ears 62 fit into appropriate slots (not visible in FIG. 10) in the top of battery housing 44, where they are bent outward or inward and serve to hold the conductive spring assembly 56 in place in the top of battery housing 44.

Removable battery cover 50 has fixedly attached to its inner surface a spring 66. The springs 66 and 60 are both biased so as to push upward and downward, respectively on batteries 48, thus keeping them in fixed relation to battery housing 44.

Figure 11:
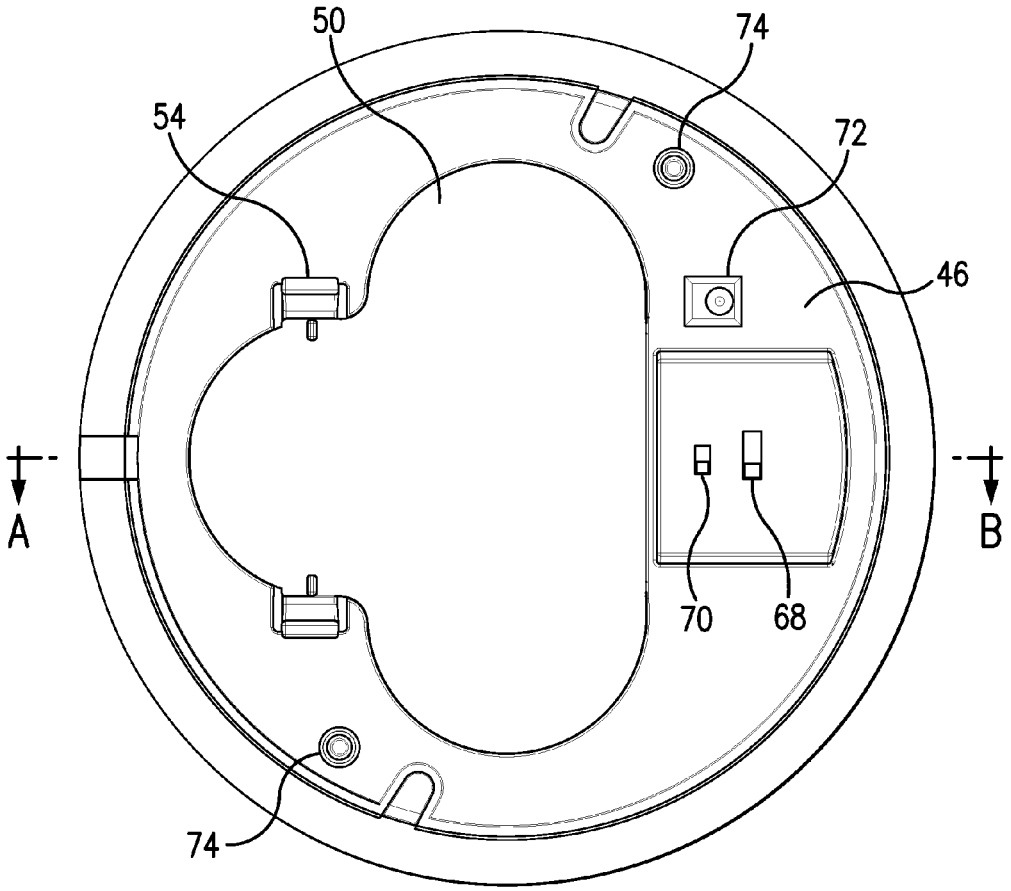
FIG. 11 is a bottom view of a portion of a preferred embodiment of the disclosure.
Figure 12:
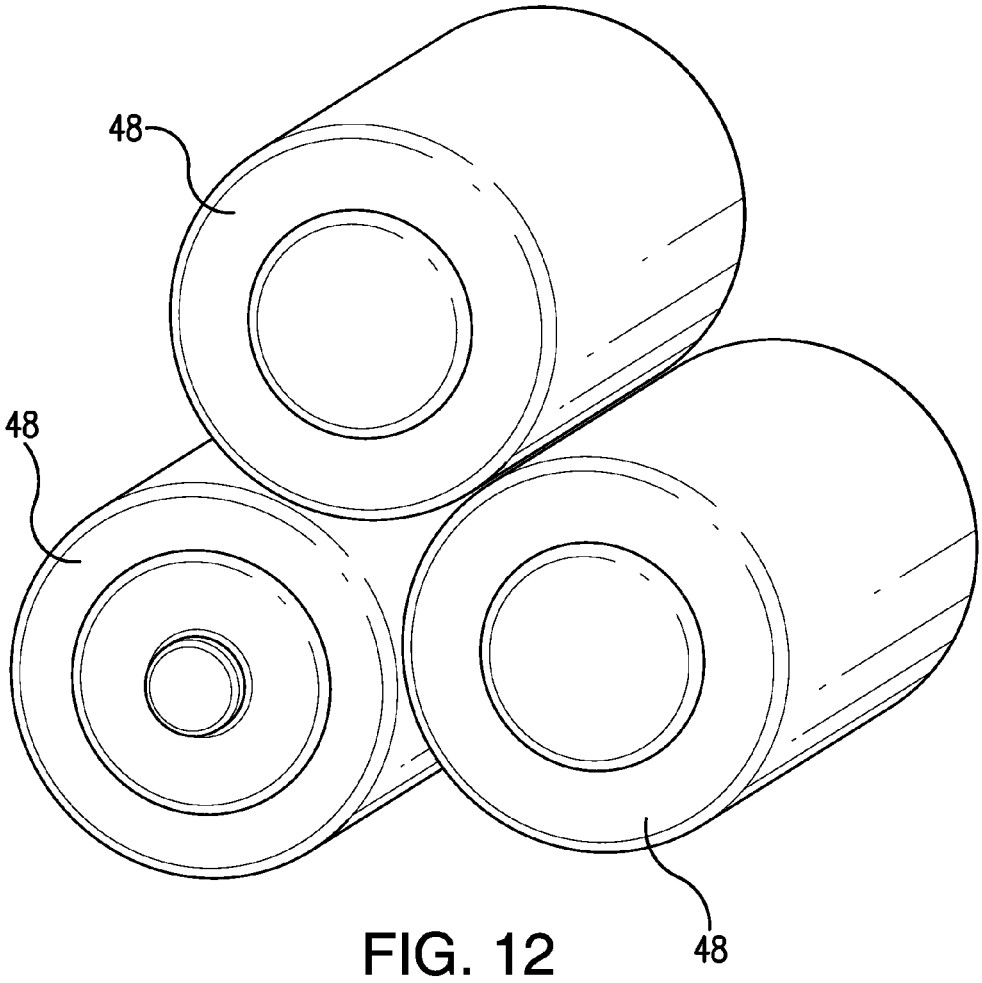
FIG. 12 illustrates a battery configuration for a portion of a preferred embodiment of the disclosure.

Referring now to FIG. 11, a bottom view of the bottom piece 46 is shown. The removable battery cover 50 is shown in place. FIG. 12 shows one possible configuration for batteries 48, which may be for instance "D" batteries. It is clear from FIGS. 11 and 12 that the battery 48 configuration shown in FIG. 12 leaves room on the bottom cover for two switches: three position switch 68 and two position switch 70. As shown in FIG. 11, the three position switch 68 is configured and arranged to toggle between settings for ON, OFF and TIMER. The two position switch 70 is configured and arranged to toggle between settings for light and pump; and light only. Together, these two switches 68 and 70 allow the decorative display apparatus 10 to be operated in a variety of modes.

Also on the bottom piece 46 is an external power source connector 72. External power source 72 is configured and arranged so as to connect to an external source of power, for instance a USB cable or a DC current supply received from a transformer in operative association with an AC current source. Screws 74 hold bottom 46 in fixed relation to lower chamber 18.

Figure 13:
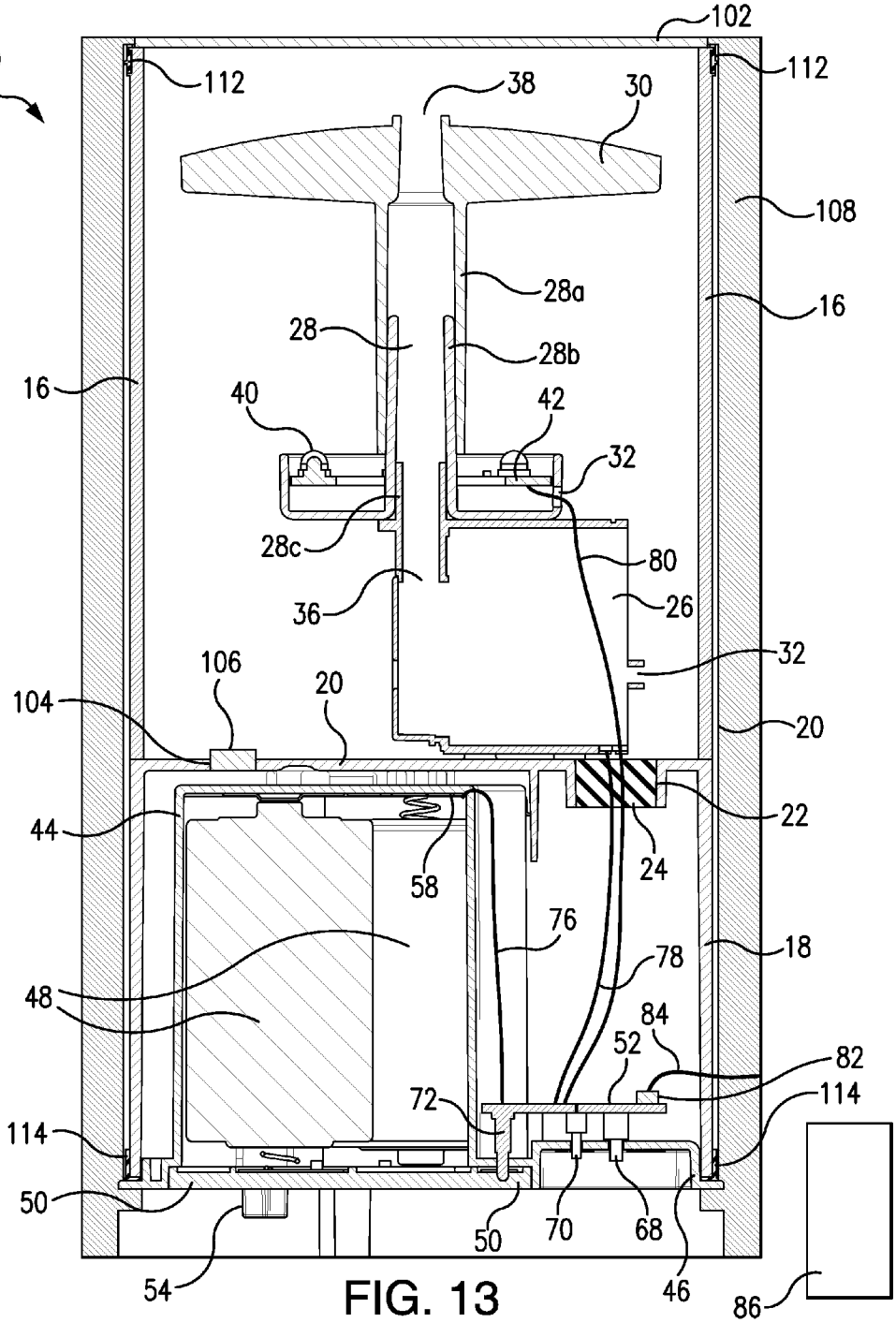
FIG. 13 is a cross-sectional view of a preferred embodiment of the disclosure.

FIG. 13 is a cross section of fully assembled apparatus 10 taken along line A-B in FIG. 11. Switches 68 and 70 protrude through bottom 46 and so are in direct communication with the switch PCB 52. Likewise, the external power source connector 72 penetrates bottom 46 and also is in direct communication with and able to supply power to switch PCB 52. Battery power is supplied to switch PCB 52 via a battery power wire 76 which extends from the conductive plate 58 to switch PCB 52.

Two wire bundles are shown extending from switch PCB 52 upwards through water tight seal 24 in through hole 22. A power/control wire bundle 78 connects switch PCB 52 to pump 26. The power/control wire bundle 78 serves to provide switch settings to pump 26, thus allowing the switches 68 and 70 to turn pump 26 ON or OFF. The power/control wire bundle 78 also supplies power, either from batteries 48 or external power source connector 72 to pump 26. Also shown extending from switch PCB 52 through water tight seal 24 to lighting PCB 42 is a lighting power/control wire bundle 80. In an analogous fashion, the lighting power/control wire bundle 80 supplies power and switch setting from the switch PCB 52 to the light PCB 42. Shown in cross section, LED's 40 are attached directly to light PCB 42 and protrude through the top of lighting cabinet 32 and thus receive power and control settings. In this way, switch settings and power are conveyed from the switch PCB 52 to the lights 40.

Also shown in FIG. 13 is a wireless receiver 82. The wireless receiver 82 is situated on PCB 52 and is constructed and arranged to pick up wireless transmissions e.g. infrared or radio frequency. These wireless transmissions emanate from a remote control transmitter 86. The remote control transmitter 86 is constructed and arranged so as to be capable of sending signals that can turn power to the flameless candle from ON or OFF or TIME, analogous to the three position switch 68, and to switch the flameless candle 10 between setting for lights only or lights and pump, analogous to the two position switch 70.

Figure 14C:
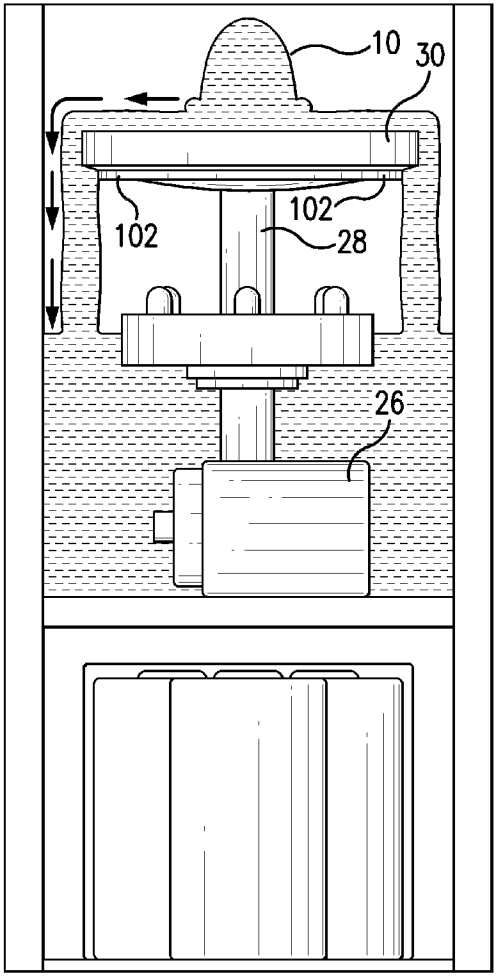
FIG. 14(*a*) is an illustration of a preferred embodiment of the disclosure showing the effect of diminished battery power on the flow pattern of water in the apparatus.
Figure 14B:
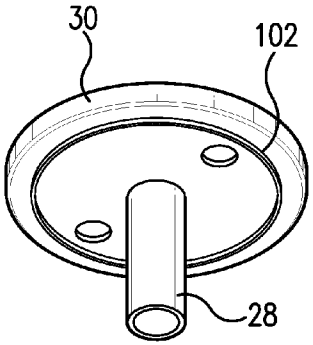
Figure 14A:
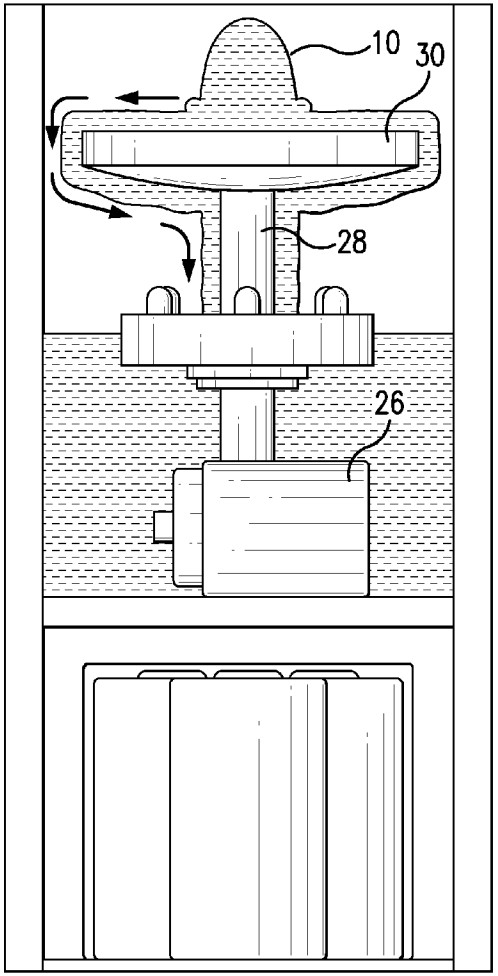

Referring now to FIG. 14, in an alternative embodiment, an optional flow diverter rib 102 is provided. FIG. 14(*a*) is an illustration of a preferred embodiment of the disclosure showing the effect of diminished battery power on the flow pattern of water in the apparatus 10. As can be seen, when the pump 26 fails to pump the water over the water and light diffuser disk 30 with sufficient vigor, as may happen when the battery power is diminishing (either toward the end of the battery life or, if rechargeable, toward the end of the battery charge cycle), water flows over and around the disk 30 but then clings to the bottom of the disk 30, finding its way to the outside of water conduit 28 and flowing downwardly. This flow pattern results in the loss of the fountain sound and substantial loss of the candle flicker effect, hampering the decorative features of the apparatus 10. This occurs because the water no longer experiences free fall, thereby defeating the waterfall-like sound, and the water's flow path is now radially inward of the lights, thereby eliminating the flicker effect that results when the light passes through the falling water.

FIG. 14(*b*) illustrates a more preferred embodiment of the disclosure showing the optional flow diverter rib 102 placed circumferentially around the underside of the water and light diffuser disk 30. This flow diverter rib 102 acts as a dam, such that water flowing along the underside of the disk 30 will collect and drop off of the rib 102, straight downward.

As shown in FIG. 14(*c*), the more preferred embodiment of the disclosure shows the effect of diminished battery power on the flow pattern of water in the apparatus 10 when the flow diverter rib 102 is in place. As can be seen, when the pump 26 fails to pump the water over the water and light diffuser disk 30 with sufficient vigor, again as may happen when the battery power is diminishing (either toward the end of the battery life or, if rechargeable, toward the end of the battery charge cycle), water flows over and around the disk 30 but then clings to the bottom of the disk 30. However, with the optional flow diverter rib 102 placed on the underside of the water and light diffuser disk 30, this flow diverter rib 102 acts as a dam. Water flowing along the underside of the disk 30 will collect and drop off of the rib 102, straight downward, thus maintaining the fountain sound and candle flicker effect, extending the effective battery life and enhancing the overall desirability of the apparatus 10. This occurs because the water still experiences free fall, thereby continuing to create the waterfall-like sound, and the water's flow path is now radially outward of the lights, thereby continuing to create the flicker effect that results when the light passes through the falling water.

As thus described, a decorative display apparatus is disclosed. The decorative display apparatus comprises a flameless candle with an integral fountain, the flameless candle with integral fountain comprising an outer sheath comprised of a wax cylinder, an optional upper reservoir liner and a lower chamber; optional upper and lower annular gaskets used to seal the interface between the outer sheath and the optional upper reservoir liner and the lower chamber. The apparatus also comprises a power source comprised of one or more batteries or a universal serial bus (USB) port or DC supply from an AC converter, wherein the power source is contained in the lower chamber and a water reservoir defined by the upper reservoir liner, or the upper interior of the outer sheath. The water reservoir may be open at the top or have an optional transparent water tight cover. The water tight cover is sealed to the optional upper reservoir inner liner if it is used. If the optional upper reservoir inner liner is not used, the transparent cover is sealed to the top of the outer sheath. Scent may optionally be added to the water reservoir if the optional transparent cover is not used. Glycerin or other antifreeze agent may also be optionally added to the water reservoir if the transparent cover is used. A water pump contained in the water reservoir and a light source comprised of light emitting diodes is contained in the upper reservoir chamber and located above the water pump. An integrated water and light diffuser comprised of a translucent plastic disk with a wax upper surface, is also contained in the water reservoir, and located above the water level in the water reservoir and above the light source. This water and light diffuser may have an optional flow diverter rib located circumferentially around its bottom periphery. A switch mechanism is contained in the lower portion of the outer casing and is in direct wired or wireless communication with the flameless candle with integrated fountain. The switch mechanism further comprises: an OFF setting; an ON setting; a timer; a pump and light setting; and a light-only setting.

The described embodiments are to be considered in all respects as illustrative and not restrictive, and the scope of the invention is, therefore, indicated by the claims and their equivalents rather than by the foregoing description. Those of skill in the art will recognize changes, substitutions and other modifications that will nonetheless come within the scope of the invention and range of the claims.

I claim:

1. A decorative display apparatus comprising:

an outer sheath, the outer sheath having an interior surface, the outer sheath further containing both an upper liquid reservoir chamber and a lower compartment configured so as not contain liquid during operation of the apparatus, the upper liquid reservoir chamber further having a liner; the liner is sealed to the interior surface of the outer sheath with an upper water tight seal and the lower compartment is sealed to the interior surface of the outer sheath with a lower water tight seal;

a liquid pump and a light source;

an integrated liquid and light diffuser positioned to support a liquid to flow over it and be illuminated by the light source, wherein the integrated liquid and light diffuser is comprised of a translucent member having an upper surface and a bottom surface;

a conduit assembly located in the upper liquid reservoir chamber in liquid communication with the liquid reservoir and the liquid pump, the conduit assembly being constructed and arranged to dispose the liquid to flow over the upper surface of the translucent member when the pump is operating; and a power source constructed and arranged to power the pump and power the light source.

2. The decorative display apparatus of claim 1, wherein the liner is transparent or translucent.

3. The decorative display apparatus of claim 1, wherein the upper water tight seal comprises an upper annular gasket and the lower water tight seal comprises a lower annular gasket.

4. The decorative display apparatus of claim 1, wherein the lower compartment is transparent or translucent.

5. The decorative display apparatus of claim 1, wherein the liner further has a sealed transparent cover.

6. The decorative display apparatus of claim 1, wherein the outer sheath comprises a translucent material.

7. The decorative display apparatus of claim 6, wherein the outer sheath comprises wax.

8. The decorative display apparatus of claim 1, wherein the outer sheath is cylindrical.

9. The decorative display apparatus of claim 1, wherein the power source comprises a battery.

10. The decorative display apparatus of claim 1, wherein the power source comprises an AC current source transformed to a DC current supply.

11. The decorative display apparatus of claim 1, wherein the light source comprises light emitting diodes (LEDs).

12. The decorative display apparatus of claim 1, wherein the liquid and light diffuser further comprises plastic and has a wax-containing upper surface.

13. The decorative display apparatus of claim 1 wherein the liquid and light diffuser further has a flow diverter rib disposed on the periphery of the bottom surface of the translucent member, wherein the flow diverter rib has an outer surface, the flow diverter rib being constructed and arranged to support a flow of liquid over the outer surface of the flow diverter rib wherein the flow of liquid is directed radially outward of the light source such that the flow of liquid is illuminated by the light source.

14. The decorative display apparatus of claim 1, further having a switch assembly constructed and arranged to selectively control power to the pump and light source.

15. The decorative display apparatus of claim 14, the switch assembly further having an ON setting; an OFF setting; a light-only setting; a pump and light setting; and a timer.

16. The decorative display apparatus of claim 14, wherein the switch assembly is in direct wired communication with the decorative display apparatus.

17. The decorative display apparatus of claim 14, wherein the switch assembly is in wireless communication with the decorative display apparatus.

18. The decorative display apparatus of claim 1, further comprising a scented ingredient added to the liquid.

19. A decorative display apparatus, the decorative display apparatus comprising:

an outer sheath having an interior surface and comprising a cylinder, the outer sheath further containing both an upper liquid reservoir chamber open at the top, and a lower compartment configured so as not to contain liquid during operation of the apparatus, the upper liquid reservoir chamber further having a transparent liner sealed to the interior surface of the outer sheath with an upper annular gasket, and the lower compartment sealed to the interior surface of the outer sheath with a lower annular gasket;

a power source having a battery and an AC current source transformed to a DC current supply, wherein the power source is contained in the lower compartment;

a liquid reservoir contained in the upper liquid reservoir chamber, having a liquid level contained in the upper liquid reservoir chamber;

a liquid pump contained in the liquid reservoir;

a light source comprised of light emitting diodes, wherein the light source is contained in the upper liquid reservoir chamber and located above the water pump;

an integrated liquid and light diffuser positioned to support the liquid to flow over it and be illuminated by the light source, wherein the integrated liquid and light diffuser is comprised of a translucent plastic disk with a wax upper surface and a bottom surface, and wherein the integrated liquid and light diffuser is contained in the upper liquid reservoir chamber, and wherein the integrated liquid and light diffuser is located above the liquid level in the upper liquid reservoir and above the light source; and a switch mechanism contained in the lower portion of the outer sheath wherein the switch mechanism is in communication with the decorative display apparatus and the switch mechanism further comprises:

an OFF setting;

an ON setting;

a timer;

a pump and light setting; and a light-only setting.

20. The decorative display apparatus of claim 19 wherein the translucent plastic disk further has a flow diverter rib disposed on the periphery of the bottom surface of the translucent plastic disk, wherein the flow diverter rib has an outer surface, the flow diverter rib being constructed and arranged to support a flow of liquid over the outer surface of the flow diverter rib wherein the flow of liquid is directed radially outward of the light source such that the flow of water is illuminated by the light source.

21. A decorative display apparatus, the decorative display apparatus comprising:

an outer sheath having an interior surface and comprising a cylinder, the outer sheath containing 1) an upper liquid reservoir chamber sealed at the top and having a transparent liner sealed to the interior surface of the outer sheath with an upper annular gasket and 2) a lower compartment configured so as not to contain liquid during operation of the apparatus sealed to the interior surface of the outer sheath with a lower annular gasket;

a power source having a battery and an AC current source transformed to a DC current supply, wherein the power source is contained in the lower compartment;

a liquid reservoir contained in the upper liquid reservoir chamber, having a liquid level contained in the upper liquid reservoir chamber;

a liquid pump contained in the liquid reservoir;

a light source comprised of light emitting diodes, wherein the light source is contained in the upper liquid reservoir and located above the water pump;

an integrated liquid and light diffuser positioned to support the liquid to flow over it and be illuminated by the light source, wherein the integrated liquid and light diffuser is comprised of a translucent plastic disk with a wax upper surface and a bottom surface, and wherein the integrated liquid and light diffuser is contained in the upper liquid reservoir chamber, and wherein the integrated liquid and light diffuser is located above the liquid level in the liquid reservoir and above the light source; and a switch mechanism contained in the lower portion of the outer sheath wherein the switch mechanism is in communication with the decorative display apparatus and the switch mechanism further comprises:

an OFF setting;

an ON setting;

a timer;

a pump and light setting; and a light-only setting.

22. The decorative display apparatus of claim 21 wherein the translucent plastic disk further has a flow diverter rib disposed on the periphery of the bottom surface of the translucent plastic disk, wherein the flow diverter rib has an outer surface, the flow diverter rib being constructed and arranged to support a flow of liquid over the outer surface of the flow diverter rib wherein the flow of liquid is directed radially outward of the light source such that the flow of water is illuminated by the light source.

23. A decorative display apparatus comprising:

an outer sheath, the outer sheath having an interior surface, the outer sheath further containing both an upper liquid reservoir chamber and a lower compartment configured so as not to contain liquid during operation of the apparatus, the upper liquid reservoir chamber having a sealed transparent cover; a transparent liner within the upper liquid reservoir chamber is sealed to the interior surface of the outer sheath with an upper annular gasket and the lower compartment is sealed to the interior surface of the outer sheath with a lower annular gasket;

a liquid pump and a light source;

an integrated liquid and light diffuser positioned to support a liquid to flow over it and be illuminated by the light source, wherein the integrated liquid and light diffuser is comprised of a translucent member having an upper surface and a bottom surface;

a conduit assembly in located in the upper liquid reservoir chamber in liquid communication with the liquid reservoir and the liquid pump, the conduit assembly being constructed and arranged to dispose the liquid to flow over the upper surface of the translucent member when the pump is operating; and a power source constructed and arranged to power the pump and power the light.

24. The decorative display apparatus of claim 23 wherein the translucent member further has a flow diverter rib disposed on the periphery of the bottom surface of the translucent member, wherein the flow diverter rib has an outer surface, the flow diverter rib being constructed and arranged to support a flow of liquid over the outer surface of the flow diverter rib wherein the flow of liquid is directed radially outward of the light source such that the flow of liquid is illuminated by the light source.

25. A decorative display apparatus comprising:

an outer sheath, the outer sheath having an interior surface, the outer sheath further containing both an upper liquid reservoir chamber and a lower compartment configured so as not to contain liquid during operation of the apparatus, wherein the lower compartment is sealed to the interior of the outer sheath with a lower annular gasket and a transparent liner within the upper liquid reservoir chamber is sealed to the interior surface of the outer sheath with an upper annular gasket;

a liquid pump and a light source;

an integrated liquid and light diffuser positioned to support a liquid to flow over it and be illuminated by the light source, wherein the integrated liquid and light diffuser is comprised of a translucent member having an upper surface and a bottom surface;

a conduit assembly located in the upper liquid reservoir chamber in liquid communication with the liquid reservoir and the liquid pump, the conduit assembly being constructed and arranged to dispose the liquid to flow over the upper surface of the translucent member when the pump is operating; and a power source constructed and arranged to power the pump and power the light.

* * * * *